US006051499A

United States Patent [19]

Tolles et al.

[11] Patent Number: 6,051,499

[45] Date of Patent: Apr. 18, 2000

[54] APPARATUS AND METHOD FOR DISTRIBUTION OF SLURRY IN A CHEMICAL MECHANICAL POLISHING SYSTEM

[75] Inventors: Robert D. Tolles, Santa Clara; William L. Guthrie, Saratoga; Jeffrey Marks, San Jose; Tsungnan Cheng, Saratoga; Semyon Spektor, San Francisco; Ivan A. Ocanada, Modesto; Norm Shendon, San Carlos, all of Calif.

[73] Assignee: Applied Materials, Inc., Santa Clara, Calif.

[21] Appl. No.: 08/982,823

[22] Filed: Dec. 2, 1997

Related U.S. Application Data

[62] Division of application No. 08/549,481, Oct. 27, 1995, Pat. No. 5,709,593.

[51] Int. Cl.[7] ..... B24B 1/00

[52] U.S. Cl. ..... 438/692; 438/691; 438/693; 216/89

[58] Field of Search ..... 438/692, 691, 438/693; 216/89; 451/6, 41

[56] References Cited

U.S. PATENT DOCUMENTS

| | | | |
|---|---|---|---|
| 3,028,711 | 4/1962 | Campbell et al. | 451/447 |
| 3,261,510 | 7/1966 | Day et al. | 451/446 |
| 3,848,366 | 11/1974 | David | 451/446 |
| 4,435,247 | 3/1984 | Basi et al. | 156/636 |
| 4,513,894 | 4/1985 | Doyle et al. | 451/446 |
| 4,600,469 | 7/1986 | Fusco et al. | 156/636 |
| 4,850,157 | 7/1989 | Holmstrand et al. | 451/446 |
| 4,910,155 | 3/1990 | Cote et al. | 437/8 |
| 5,234,867 | 8/1993 | Schultz et al. | 437/225 |
| 5,245,796 | 9/1993 | Miller et al. | 51/283 |
| 5,246,525 | 9/1993 | Sato | 156/345 |
| 5,291,693 | 3/1994 | Nguyen | 51/283 |
| 5,433,650 | 7/1995 | Winebarger | 451/6 |
| 5,562,530 | 10/1996 | Runnels et al. | 451/36 |
| 5,650,039 | 7/1997 | Talieh | 156/636 |

*Primary Examiner*—Bruce Breneman
*Assistant Examiner*—Rudy Zervigon
*Attorney, Agent, or Firm*—Fish & Richardson

[57] ABSTRACT

Slurry is provided to the surface of the polishing pad by pumping the slurry up through a central port, or by dripping the slurry down onto the surface of the polishing pad from a slurry feed tube. A slurry wiper, which may have one or more flexible members, sweeps the slurry evenly and thinly across the polishing pad. A control system coordinates the distribution of slurry to the polishing pad with the motion of the carrier head.

8 Claims, 17 Drawing Sheets

APPARATUS AND METHOD FOR DISTRIBUTION OF SLURRY IN A CHEMICAL MECHANICAL POLISHING SYSTEM

CROSS REFERENCE TO RELATED APPLICATIONS

This application is a divisional of application Ser. No. 08/549,481, filed Oct. 27, 1995 now U.S. Pat. No. 5,709, 593.

BACKGROUND OF THE INVENTION

The invention relates to chemical mechanical polishing of substrates, and more particularly to an apparatus and method for distributing slurry to the surface of a polishing pad.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of the substrate where the least etching has occurred, and least in regions where the greatest etching has occurred. With a single patterned underlying layer, this non-planar surface comprises a series of peaks and valleys wherein the distance between the highest peak and the lowest valley may be on the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photolithographic techniques used to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar, outer surface, whether conductive, semiconductive, or insulative, to form a relatively flat, smooth surface. Following planarization, additional layers may be deposited on the outer surface to form interconnect lines between features, or the outer surface may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the finish (roughness) and flatness (lack of large scale topography) of the substrate surface, and the polishing rate. Inadequate flatness and finish can produce substrate defects. The polishing rate sets the time needed to polish a layer. Thus, it sets the maximum throughput of the polishing apparatus.

Each polishing pad provides a surface which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

An additional limitation on polishing throughput is "glazing" of the polishing pad. Glazing occurs when the polishing pad becomes packed with the byproducts of polishing and as the pad is compressed in regions where the substrate is pressed against it. The peaks of the polishing pad are pressed down and the pits of the polishing pad are filled up, so the surface of the polishing pad becomes smoother and less abrasive. As a result, the time required to polish a substrate increases. Therefore, the polishing pad surface must be periodically returned to an abrasive condition, or "conditioned", to maintain a high throughput.

An additional consideration in the production of integrated circuits is process and product stability. To achieve a low defect rate, each successive substrate should be polished under similar conditions. Each substrate should be polished by approximately the same amount so that each integrated circuit is substantially identical.

In view of the foregoing, there is a need for a chemical mechanical polishing apparatus which optimizes polishing throughput, flatness, and finish, while minimizing the risk of contamination or destruction of any substrate.

Specifically, there is a need for an apparatus and method to distribute slurry to the surface of the polishing pad. The apparatus slurry distribution system should provide slurry in an even, uniform layer across the entire polishing pad. In addition, the system should reduce slurry consumption in the polishing process.

Additional advantages of the invention will be set forth in the description which follows, and in part will be obvious from the description, or may be learned by practice of the invention. The advantages of the invention may be realized by means of the instrumentalities and combinations particularly pointed out in the claims.

SUMMARY OF THE INVENTION

In one embodiment, the present invention is a method of polishing a substrate in a chemical mechanical polishing apparatus. The method comprises rotating the substrate and the polishing pad, bringing the substrate into contact with the polishing pad, and dispensing a slurry solution through a central port.

The slurry may be dispensed at a first flow rate if the substrate is not positioned over the central port, and at a second, higher, flow rate if the substrate is positioned over the central port. Slurry may be pumped through the central port in intermittent pulses. The flow rate during the pulses may be sufficiently high to overcome pressure from the carrier head.

In another embodiment, the present invention is a chemical mechanical polishing apparatus. The apparatus comprises a rotating polishing pad, a slurry dispenser, and a flexible member disposed to sweep slurry across the surface of the polishing pad.

The flexible member may extend linearly from the edge to near the center of the polishing pad. A gap may separate the flexible member from the polishing pad, or the flexible member may contact the surface of the polishing pad. Multiple flexible members can be used. The flexible member may be mounted to a rigid arm. The arm may be connected to a rotary motor to move the arm over the polishing pad. The apparatus may also include a control system to control the motion of the carrier head and the arm to prevent collisions therebetween.

BRIEF DESCRIPTION OF THE DRAWINGS

The accompanying drawings, which are incorporated in and constitute a part of the specification, schematically illustrate the invention, and together with the general description given above and the detailed description given below, serve to explain the principles of the invention.

Description of the Preferred Embodiment(s)

Figure 1A:
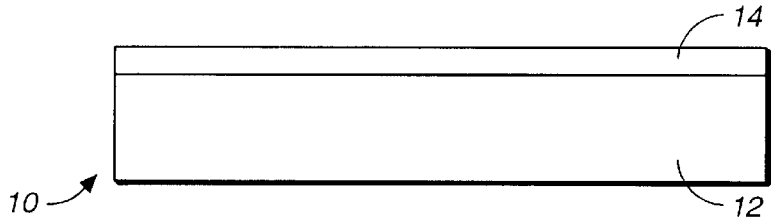
FIGS. 1A–1E are schematic diagrams illustrating the deposition and etching of a layer on a substrate.
Figure 1B:
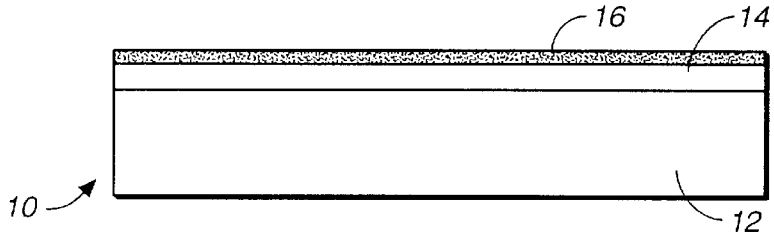
Figure 1C:
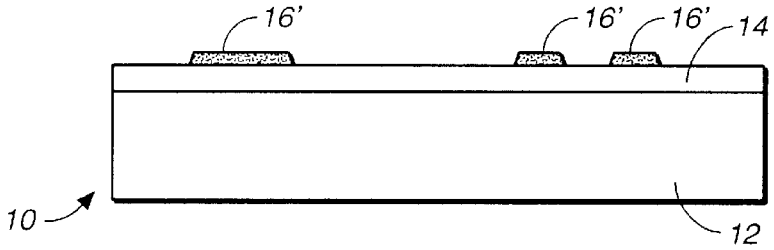
Figure 1D:
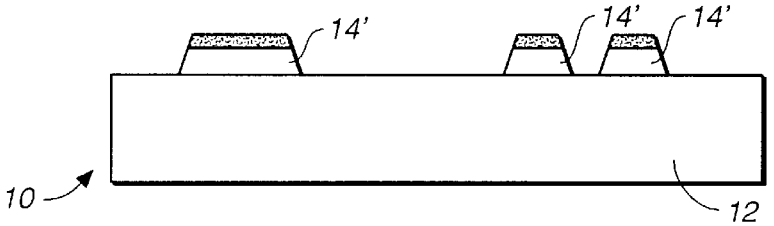
Figure 1E:
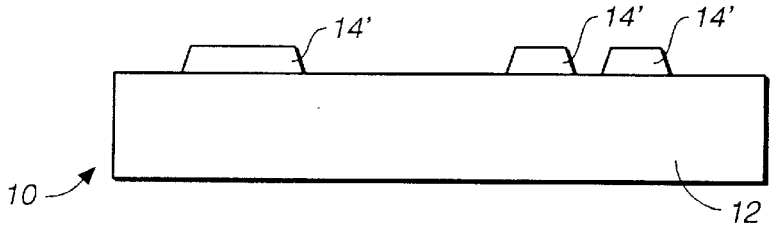

FIGS. 1A–1E illustrate the process of depositing a layer onto a planar surface of a substrate. As shown in FIG. 1A, a substrate 10 might be processed by coating a flat semiconductive silicon wafer 12 with a metal layer 14, such as aluminum. Then, as shown in FIG. 1B, a layer of photoresist 16 may be placed on metal layer 14. Photoresist layer 16 can then be exposed to a light image, as discussed in more detail below, producing a patterned photoresist layer 16' shown in FIG. 1C. As shown in FIG. 1D, after patterned photoresist layer 16' is created, the exposed portions of metal layer 14 are etched to create metal islands 14'. Finally, as shown in FIG. 1E, the remaining photoresist is removed.

Figure 2A:
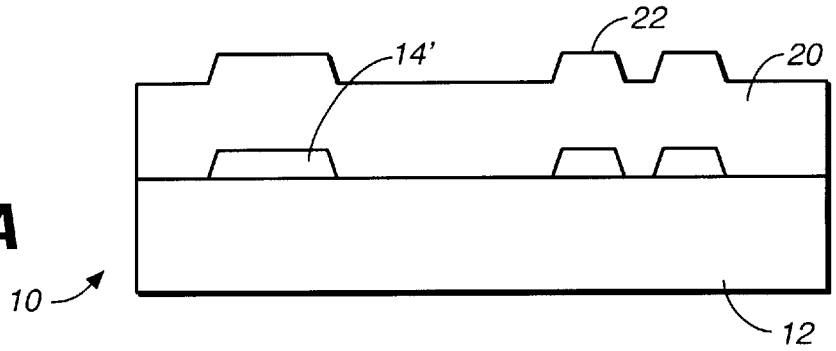
FIGS. 2A–2C are schematic diagrams illustrating the polishing of a non-planar outer surface of a substrate.
Figure 2B:
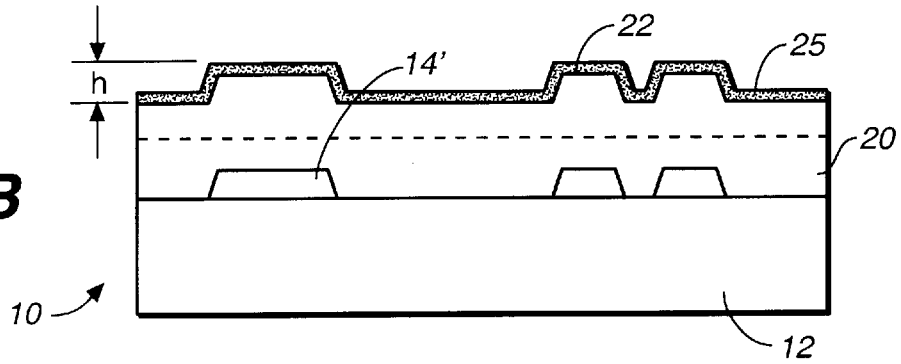

FIGS. 2A–2B illustrate the difficulty presented by deposition of subsequent layers on a substrate. As shown in FIG. 2A, an insulative layer 20, such as silicon dioxide, may be deposited over metal islands 14'. The outer surface 22 of insulative layer 20 almost exactly replicates the underlying structures of the metal islands, creating a series of peaks and valleys. An even more complicated outer surface would be generated by depositing and etching multiple layers on an underlying patterned layer.

If, as shown in FIG. 2B, outer surface 22 of substrate 10 is non-planar, then a photoresist layer 25 placed thereon is also non-planar. A photoresist layer is typically patterned by a photolithographic apparatus that focuses a light image onto the photoresist. Such an imaging apparatus typically has a depth of focus of about 0.2 to 0.4 microns for sub-halfmicron feature sizes. If the photoresist layer 25 is sufficiently non-planar, that is, if the maximum height difference h between a peak and valley of outer surface 22 is greater than the depth of focus of the imaging apparatus, then it will be impossible to properly focus the light image onto the entire outer surface 22. Even if the imaging apparatus can accommodate the non-planarity created by a single underlying patterned layer, after the deposition of a sufficient number of patterned layers, the maximum height difference will exceed the depth of focus.

It may be prohibitively expensive to design new photolithographic devices having an improved depth of a focus. In addition, as the feature size used in integrated circuits becomes smaller, shorter wavelengths of light must be used, resulting in further reduction of the available depth of focus.

Figure 2C:
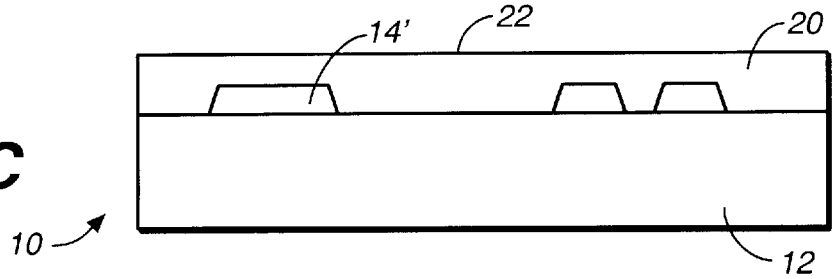

A solution, as shown in FIG. 2C, is to planarize the outer surface. Planarization wears away the outer surface, whether metal, semiconductive, or insulative, to form a substantially smooth, flat outer surface 22. As such, the photolithographic apparatus can be properly focused. Planarization could be performed only when necessary to prevent the peak-to-valley difference from exceeding the depth of focus, or planarization could be performed each time a new layer is deposited over a patterned layer.

Polishing may be performed on metallic, semiconductive, or insulative layers. The particular reactive agents, abrasive particles, and catalysts will differ depending on the surface being polishing. The present invention is applicable to polishing of any of the above layers.

Figure 3:
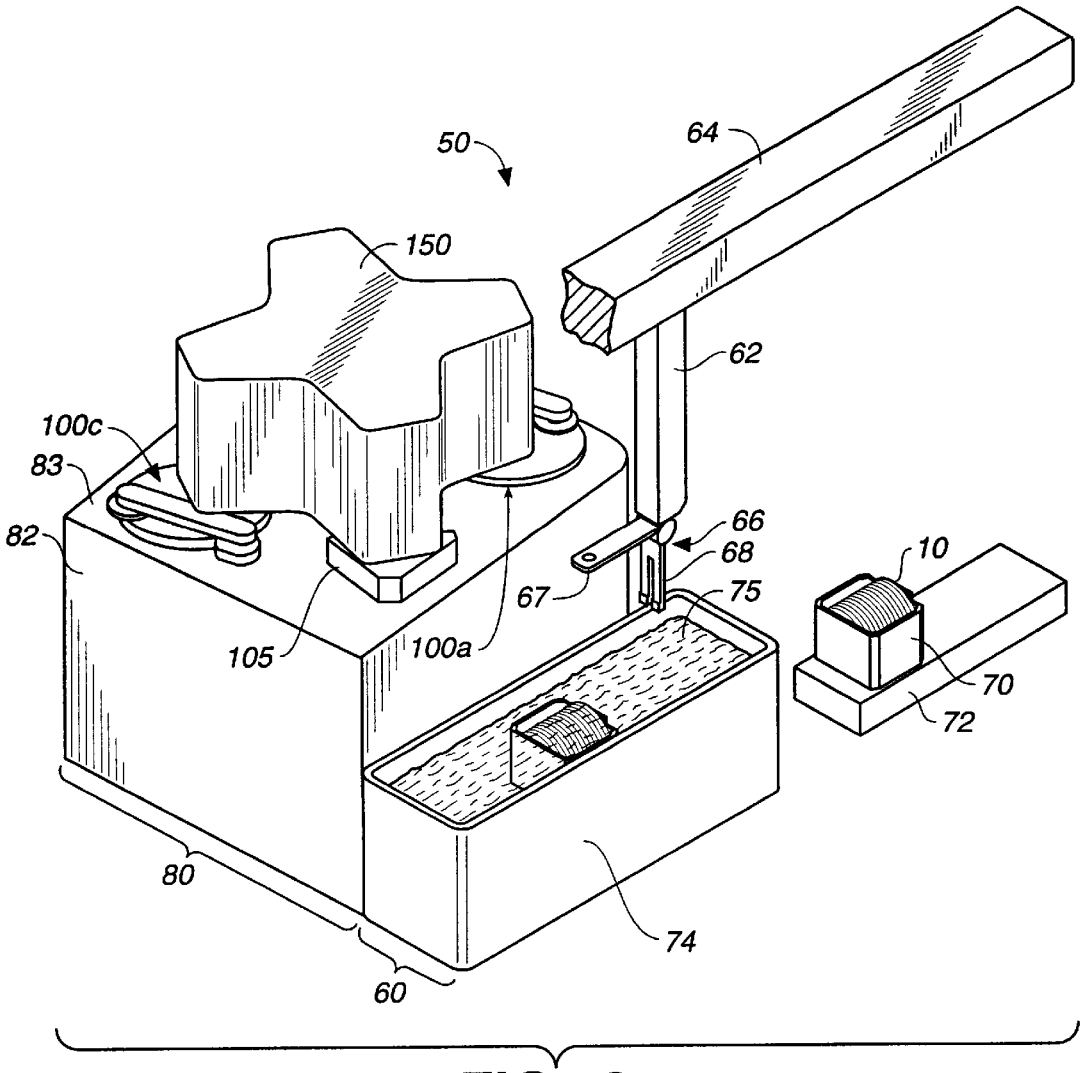
FIG. 3 is a schematic perspective view of a chemical mechanical polishing apparatus.

As shown in FIG. 3, a chemical mechanical polishing system 50 according to the present invention includes a loading apparatus 60 adjacent to a polishing apparatus 80. Loading apparatus 60 includes a rotatable, extendable arm 62 hanging from an overhead track 64. In the figure, overhead track 64 has been partially cut-away to more clearly show polishing apparatus 80. Arm 62 ends in a wrist assembly 66 which includes a blade 67 with a vacuum port and a cassette claw 68.

Substrates 10 are brought to polishing system 50 in a cassette 70 and placed on a holding station 72 or directly into a tub 74. Cassette claw 68 on arm 64 may be used to grasp cassette 70 and move it from holding station 72 to tub 74. Tub 74 is filled with a liquid bath 75, such as deionized water. Blade 67 fastens to an individual substrate from cassette 70 in tub 74 by vacuum suction, removes the substrate from cassette 70, and loads the substrate into polishing apparatus 80. Once polishing apparatus 80 has completed polishing the substrate, blade 67 returns the substrate to the same cassette 70 or to a different one. Once all of the substrates in cassette 70 are polished, claw 68 may remove cassette 70 from tub 74 and return the cassette to holding station 72.

Figure 4:
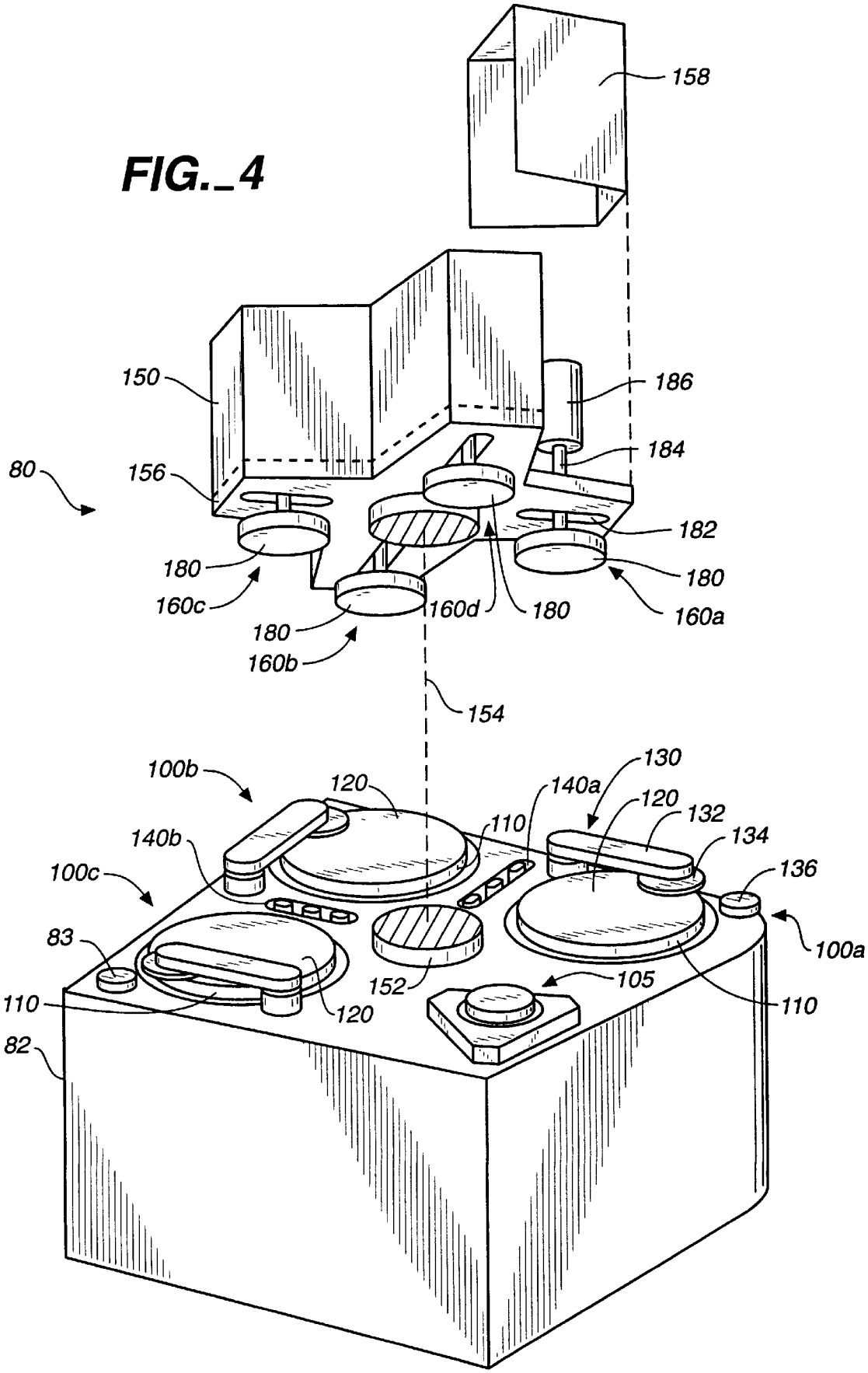
FIG. 4 is a schematic exploded perspective view of the chemical mechanical polishing apparatus of FIG. 3.

Polishing apparatus 80 includes a lower machine base 82 with a table top 83 mounted thereon and removable upper outer cover (not shown). As best seen in FIG. 4, table top 83 supports a series of polishing stations 100*a*, 100*b* and 100*c*, and a transfer station 105. Transfer station 105 forms a generally square arrangement with the three polishing stations 100*a*, 100*b* and 100*c*. Transfer station 105 serves multiple functions of receiving individual substrates 10 from loading apparatus 60, washing the substrates, loading the substrates into carrier heads (to be described below), receiving the substrates from the carrier heads, washing the substrates again, and finally transferring the substrates back to loading apparatus 60 which returns the substrates to the cassette.

Each polishing station 100*a*, 100*b*, or 100*c* includes a rotatable platen 110 on which is placed a polishing pad 120. Each polishing station 100*a*, 100*b* and 100*c* may further include an associated pad conditioner apparatus 130. Each pad conditioner apparatus 130 has a rotatable arm 132 holding an independently rotating conditioner head 134 and an associated washing basin 136. The conditioner apparatus maintains the condition of the polishing pad so it will effectively polish any substrate pressed against it while it is rotating.

Several intermediate washing stations 140*a* and 140*b* may be positioned between neighboring polishing stations 100*a*, 100*b* and 100*c*. Washing stations 140*a* and 140*b* rinse the substrates as they pass from one polishing station to another.

A rotatable multi-head carousel 150 is positioned above lower machine base 82. Carousel 150 is supported by a center post 152 and rotated thereon about a carousel axis 154 by a carousel motor assembly located within base 82. Center post 152 supports a carousel support plate 156 and a cover 158. Multi-head carousel 150 includes four carrier head systems 160*a*, 160*b*, 160*c*, and 160*d*. Three of the carrier head systems receive and hold a substrate, and polish it by pressing it against the polishing pad 120 on platen 110 of polishing stations 100*a*, 100*b* and 100*c*. One of the carrier head systems receives substrates from and delivers substrates to transfer station 105.

In the preferred embodiment, the four carrier head systems 160*a*–160*d* are mounted on carousel support plate 156 at equal angular intervals about carousel axis 154. Center post 152 supports carousel support plate 156 and allows the carousel motor to rotate the carousel support plate 156 and to orbit the carrier head systems 160*a*–160*d*, and the substrates attached thereto, about carousel axis 154.

Each carrier head system 160*a*–160*d* includes a polishing or carrier head 180. Each carrier head 180 independently rotates about its own axis, and independently laterally oscillates in a radial slot 182 formed in support plate 156. A carrier drive shaft 184 connects a carrier head rotation motor 186 to carrier head 180 (shown by the removal of one-quarter of cover 158). There is one carrier drive shaft and motor for each head.

The substrates attached to the bottom of carrier heads 180 may be raised or lowered by the polishing head systems 160*a*–160*d*. An advantage of the overall carousel system is that only a short vertical stroke is required of the polishing head systems to accept substrates, and position them for polishing and washing. An input control signal (e.g., a pneumatic, hydraulic, or electrical signal), causes expansion or contraction of carrier head 180 of the polishing head systems in order to accommodate any required vertical stroke. Specifically, the input control signal causes a lower carrier member having a substrate receiving recess to move vertically relative to a stationary upper carrier member.

During actual polishing, three of the carrier heads, e.g., those of polishing head systems 160*a*–160 *c*, are positioned at and above respective polishing stations 100*a*–100*c*. Each rotatable platen 110 supports a polishing pad 120 with a top surface which is wetted with an abrasive slurry. Carrier head 180 lowers a substrate to contact polishing pad 120, and the abrasive slurry acts as the media for both chemically and mechanically polishing the substrate or wafer.

After each substrate is polished, polishing pad 120 is conditioned by conditioning apparatus 130. Arm 132 sweeps conditioner head 134 across polishing pad 120 in an oscillatory motion generally between the center of polishing pad 120 and its perimeter. Conditioner head 134 includes an abrasive surface, such as a nickel-coated diamond surface. The abrasive surface of conditioner head 134 is pressed against rotating polishing pad 120 to abrade and condition the pad.

In use, the polishing head 180, for example, that of the fourth carrier head system 160*d*, is initially positioned above the wafer transfer station 105. When the carousel 150 is rotated, it positions different carrier head systems 160*a*, 160*b*, 160*c*, and 160*d* over the polishing stations 100*a*, 100*b* and 100*c*, and the transfer station 105. The carousel 150 allows each polishing head system to be sequentially located, first over the transfer station 105, and then over one or more of the polishing stations 100*a*–100*c*, and then back to the transfer station 105.

Figure 5A:
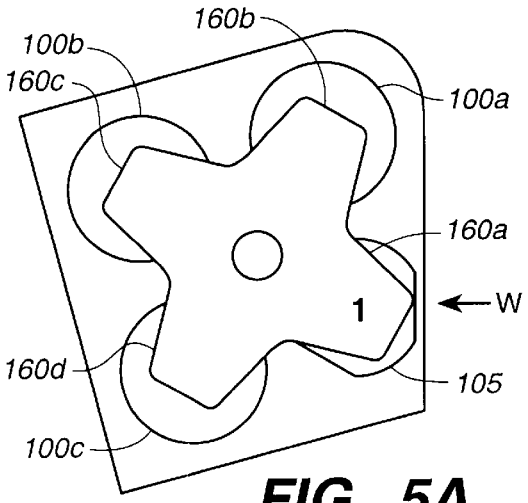
FIGS. 5A–5F are schematic top views of the polishing apparatus illustrating the progressive movement of wafers as they are sequentially loaded and polished.
Figure 5B:
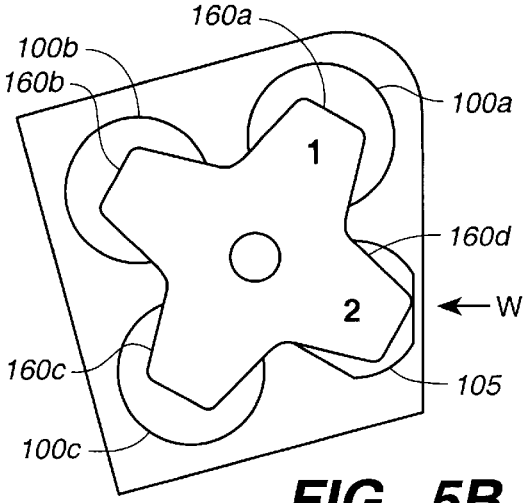
Figure 5C:
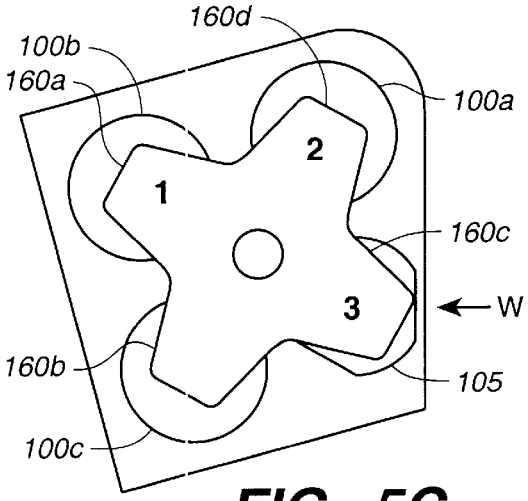
Figure 5D:
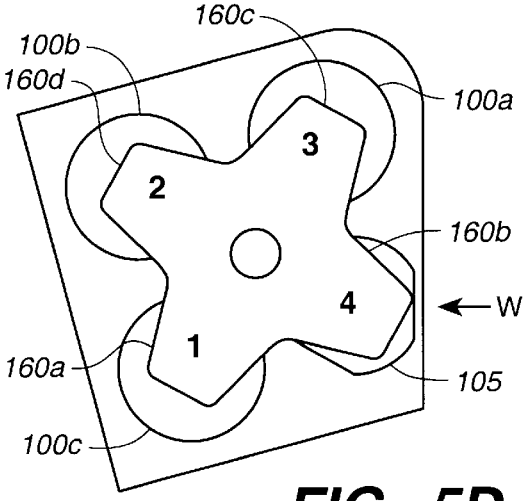
Figure 5E:
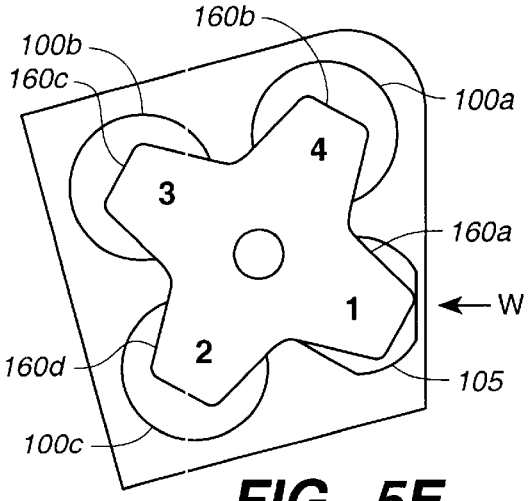
Figure 5F:
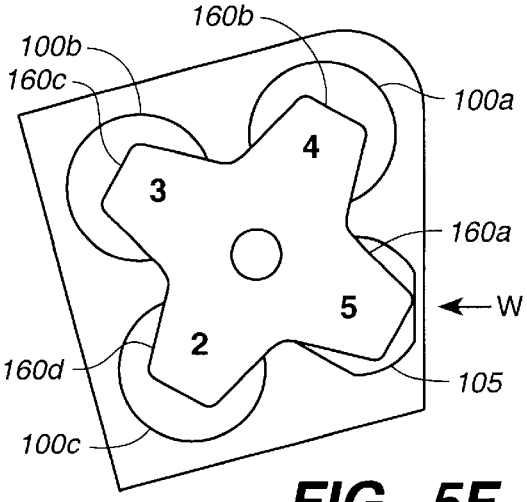

FIGS. 5A–5F show the carrousel 150 and its movement with respect to the insertion of a substrate such as a wafer (W) and subsequent movement of carrier head systems 160*a*–160*d*. As shown in FIG. 5A, a first wafer W#1 is loaded from loading apparatus 60 into transfer station 105, where the wafer is washed and then loaded into a carrier head 180, e.g., that of a first carrier head system 160*a*. Carousel 150 is then rotated counter-clockwise on supporting center post 152 so that, as shown in FIG. 5B, first carrier head system 160*a* with wafer W#1 is positioned at the first polishing station 100*a*, which performs a first polish of wafer W#1. While first polishing station 100*a* is polishing wafer W#1, a second wafer W#2 is loaded from loading apparatus 60 to transfer station 105 and from there to a second carrier head system 160*b*, now positioned over transfer station 105. Then carousel 150 is again rotated counter-clockwise by 90° so that, as shown in FIG. 5C, first wafer W#1 is positioned over second polishing station 100*b* and second wafer W#2 is positioned over first polishing station 100*a*. A third carrier head system 100*c* is positioned over transfer station 105, from which it receives a third wafer W#3 from loading system 60. In a preferred embodiment, during the stage shown in FIG. 5C, wafer W#1 at second polishing station 100*b* is polished with a slurry of finer grit than wafer W#1 at the first polishing station 100*a*. In the next stage, as illustrated by FIG. 5D, carousel 150 is again rotated counter-clockwise by 90° so as to position wafer W#1 over third polishing station 100*c*, wafer W#2 over second polishing station 100*c*, and wafer W#3 over first polishing station 100*a*, while a fourth carrier head system 160*d* receives a fourth wafer W#4 from loading apparatus 60. The polishing at third polishing station 100*c* is presumed to be even finer than that of second polishing station 100*b*. After the completion of this stage, carousel 150 is again rotated. However, rather than rotating it counter-clockwise by 90°, carousel 150 is rotated clockwise by 270°. By avoiding continuous rotation in one direction, carousel 150 may use simple flexible fluid and electrical connections rather than complex rotary couplings. The rotation, as shown in FIG. 5E, places wafer W#1 over transfer station 105, wafer W#2 over third polishing station 100*c*, wafer W#3 over second polishing station 100*b*, and wafer W#4 over first polishing station 100*a*. While wafers W#1–W#3 are being polished, wafer W#1 is washed at transfer station 105 and returned from carrier head system 160*a* to loading apparatus 60. Finally, as illustrated by FIG. 5F, a fifth wafer W#5 is loaded into first carrier head system 160*a*. After this stage, the process is repeated.

Figure 6:
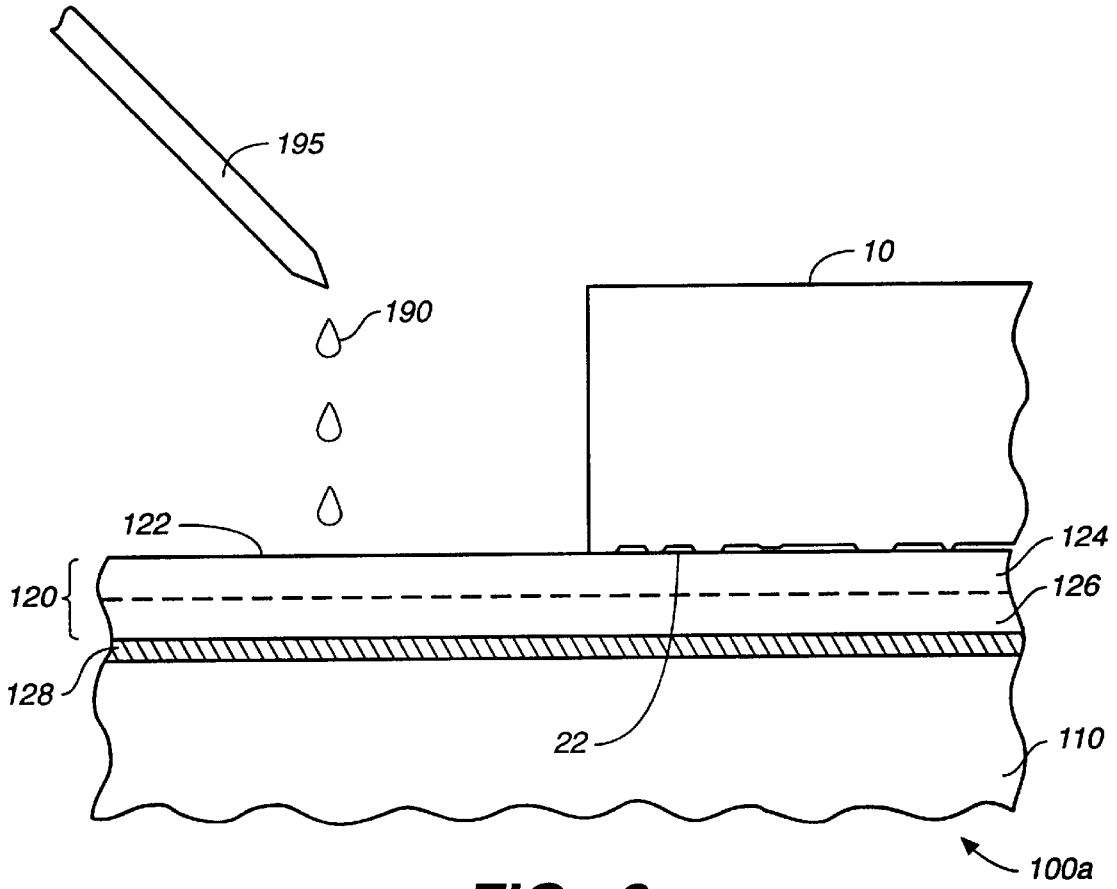
FIG. 6 is a schematic side view of a substrate on a polishing pad.

As shown in FIG. 6, a carrier head system, such as system 160*a*, lowers substrate 10 to engage a polishing station, such as polishing station 100*a*. As noted, each polishing station includes a rigid platen 110 supporting a polishing pad 120. If substrate 10, is an eight-inch (200 mm) diameter disk, then platen 110 and polishing pad 120 will be about twenty inches in diameter. Platen 110 is preferably a rotatable aluminum or stainless steel plate connected by a stainless steel platen drive shaft (not shown) to a platen drive motor (not shown). For most polishing processes, the drive motor rotates platen 110 at thirty to two-hundred revolutions per minute, although lower or higher rotational speeds may be used.

Polishing pad 120 is a hard composite material with a roughened surface 122. Polishing pad 120 may have a fifty mil thick hard upper layer 124 and a fifty mil thick softer lower layer 126. Upper layer 124 is preferably a material composed of polyurethane mixed with other fillers. Lower layer 126 is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.). In one embodiment, polishing pad 120 is attached to platen 110 by a pressure-sensitive adhesive layer 128.

Each carrier head system includes a rotatable carrier head. The carrier head holds substrate 10 with the top surface 22 pressed face down against outer surface 122 of polishing pad 120. For the main polishing step, usually performed at station 100*a*, carrier head 180 applies a force of approximately four to ten pounds per square inch (psi) to substrate 10. At subsequent stations, carried head 180 may apply more or less force. For example, for a final polishing step, usually performed at station 100*c*, carrier head 180 applies about three psi. Carrier drive motor 186 (see FIG. 4) rotates carrier head 180 at about thirty to two-hundred revolutions per minute. In a preferred embodiment, platen 110 and carrier head 180 rotate at substantially the same rate.

A slurry 190 containing a reactive agent (e.g., deionized water for oxide polishing), abrasive particles (e.g., silicon dioxide for oxide polishing) and a chemically reactive catalyzer (e.g., potassium hydroxide for oxide polishing), is supplied to the surface of polishing pad 120 by a slurry supply tube 195. Sufficient slurry is provided to cover and wet the entire polishing pad 120.

As mentioned above, slurry is applied to the surface of the polishing pad during chemical mechanical polishing (CMP). The distribution of slurry to the polishing pad affects the polishing process. The so-called "dry" areas of a polishing pad, i.e., areas with less slurry, have fewer abrasive particles and a lower concentration of reactive agents, and therefore polish the substrate at a slower rate than areas with more slurry. Consequently, non-uniform distribution of slurry over the pad can result in non-uniform polishing. In addition, the slurry may degrade over time and as it is being used. As a result, the abrasive particles may algomerate, resulting in scratches to the outer surface of the substrate. Therefore, slurry should be distributed evenly across the surface of the polishing pad, and it should be continuously replenished during the polishing process.

Slurry is an expensive consumable. A CMP system can use more than two hundred milliliters of slurry per minute. Because each substrate can take two to three minutes to polish, a CMP system can easily use a sixth of a gallon of slurry per substrate. The per substrate cost of CMP could be reduced considerably by reducing the amount of slurry used. In addition, if there is too much slurry, the substrate can hydroplane over the surface of the polishing pad, resulting in a reduction in the polishing rate. Therefore, ideally, the slurry should be distributed thoroughly and evenly in a thin layer on the polishing pad surface.

The present invention includes two mechanisms to deliver slurry to polishing pad 120. One mechanism, described with reference to FIGS. 7–9B and 15–16, is a slurry port in the center of platen 110 wherein slurry is pumped through the port in a controllable fashion to the center of the polishing pad. Another mechanism, described with reference to FIGS. 10A–11B, is a slurry feed tube which drips slurry onto the surface of the polishing pad. The present invention also includes a slurry wiper, described with reference to FIGS. 10A–11B and 15–16, which distributes slurry evenly and thinly across polishing pad 120.

Central Slurry Feed Port

Figure 7:
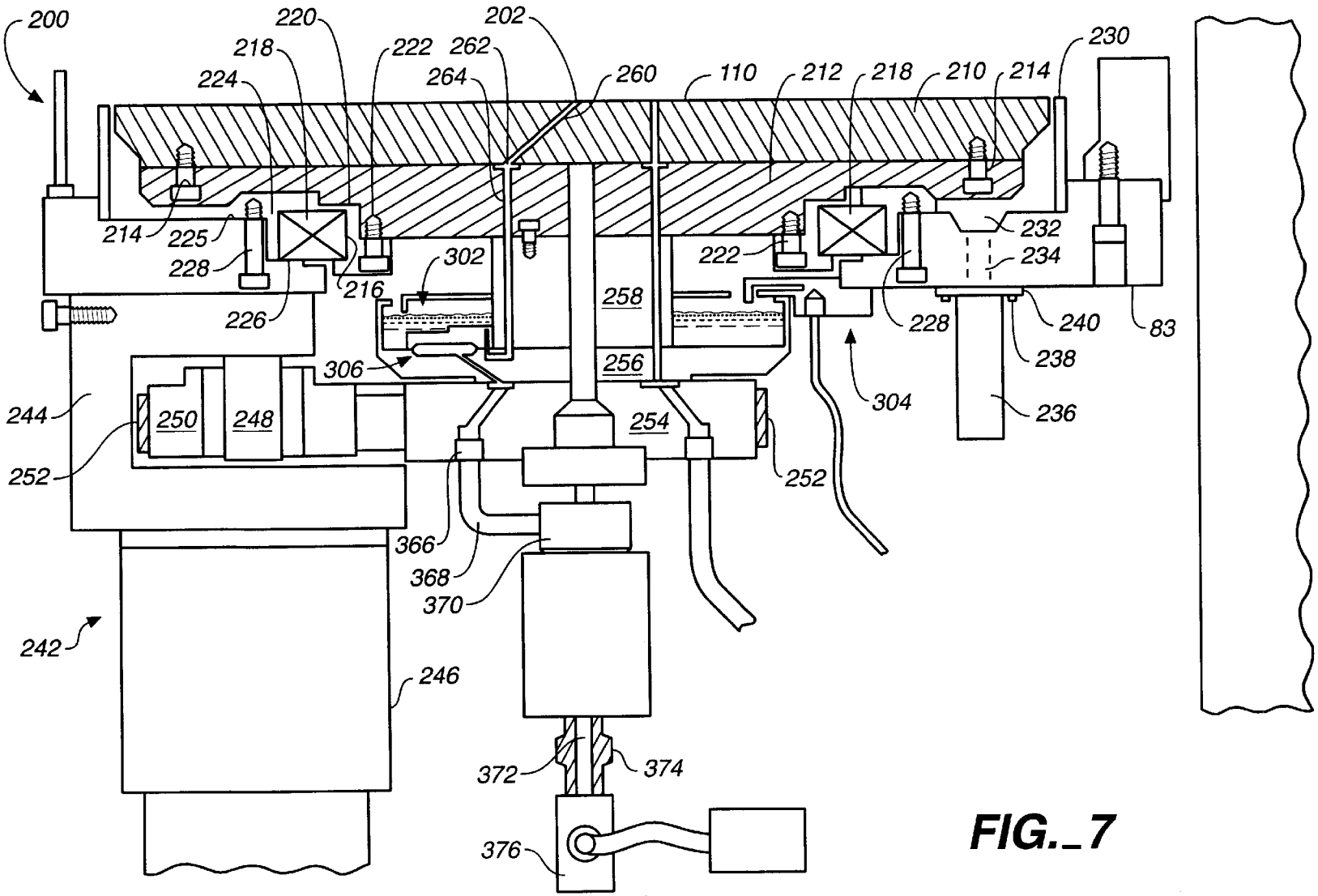
FIG. 7 is a schematic cross-sectional view of a platen assembly with a central slurry port.

A platen assembly 200, as discussed, is disposed at every polishing station 100*a*, 100*b* and 100*c*. As shown in FIG. 7, the platen assembly includes a central or center port 202 in the platen to provide slurry to the surface of polishing pad 120. Platen 110 includes a platen top 210 and a platen base 212 joined by several peripheral screws 214 countersunk into the bottom of platen base 212.

A first collar 216 at the bottom of platen base 212 captures the inner race of an annular bearing 218 against a flat cylindrical cornice 220 formed on the bottom of platen base 212. A set of screws 222 countersunk into the bottom of first collar 216 extend into the bottom of platen base 212 to hold the inner race of annular bearing 218. Table top 83 supports a second collar 224 which protrudes upwardly into an annular cavity 225 in the bottom of platen base 212. Second collar 224 captures the outer race of annular bearing 218 against a ledge 226 formed in table top 83. A set of screws 228 countersunk into the bottom of table top 83 extend into second collar 224 to hold the outer race of annular bearing 218.

A circular weir 230 surrounds platen 110 and captures slurry and associated liquids centrifugally expelled from platen 110. This slurry collects in a trough 232 formed on table top 83 by weir 230 and second collar 224. The slurry then drains through a hole 234 in table top 83 to a drain pipe 236. Screws 238 pass through a flange 240 of drain pipe 236 and into the bottom of table top 83 to attach drain pipe 236 to table top 83.

A platen motor assembly 242 is bolted to the bottom of table top 83 through a mounting bracket 244. Motor assembly 242 includes a motor 246 with an output shaft 248 extending vertically upwards. Output shaft 248 is spline fit to a solid motor sheave 250. A drive belt 252 winds around motor sheave 250 and around a hub sheave 254. Hub sheave 254 is joined to platen base 212 by a reservoir hub 256 and a platen hub 258. Platen hub 258 is sealed to the central portion of reservoir hub 256.

An angular passage 260 in platen top 210 connects center port 202 to a recess 262. An O-ring in recess 262 aligns and seals angular passage 260 to a vertical passage 264 in platen base 212. The rotation of platen 110 tends to equally distribute the slurry from center port 202 over the surface of polishing pad 120.

Figure 8:
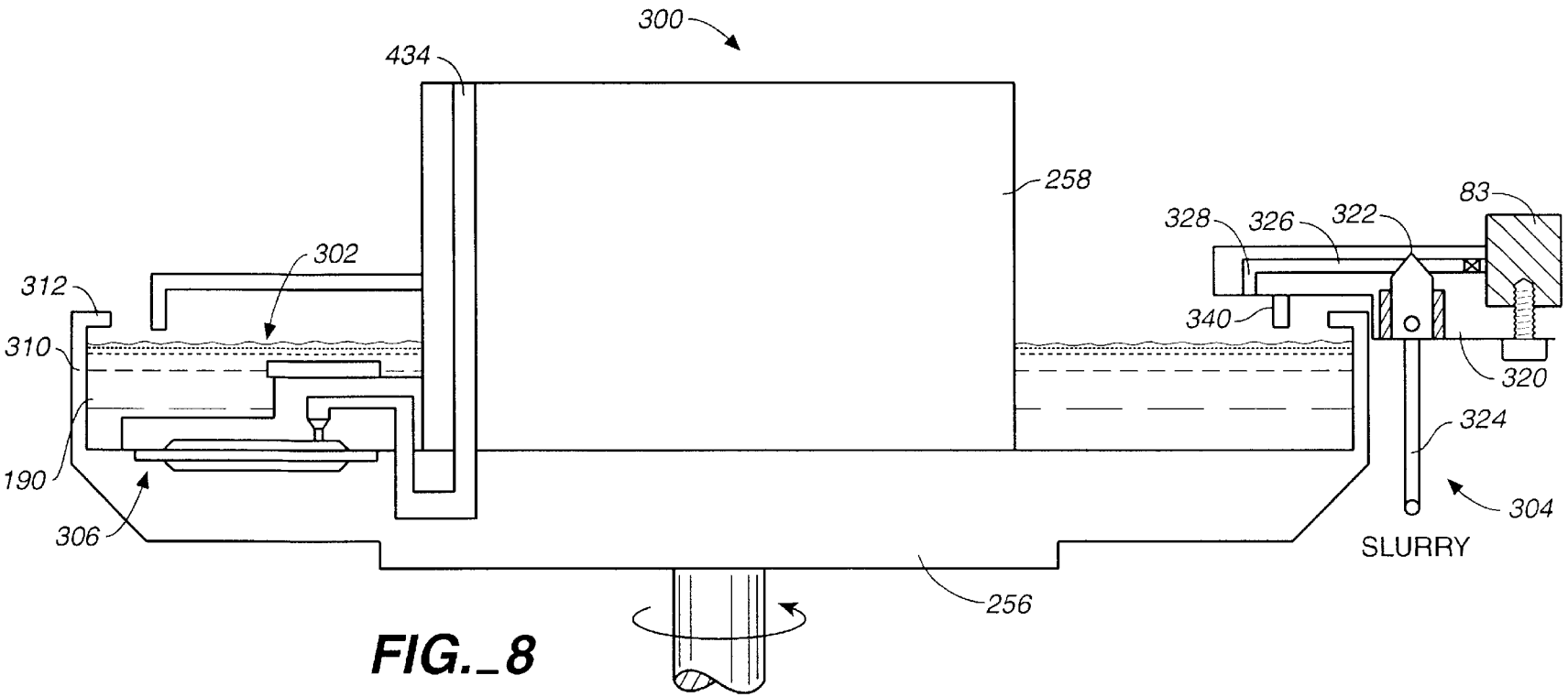
FIG. 8 is a schematic cross-sectional view of a reservoir system for a platen assembly.

As shown in FIGS. 7 and 8, the slurry distribution system includes a slurry reservoir system 300 to contain slurry 190 to be distributed via center port 202. The reservoir system includes a rotating reservoir 302, a stationary slurry feed assembly 304 to provide slurry to reservoir 302, and a rotating pump 306 to pump slurry from reservoir to center port 202. The outer periphery of reservoir hub 256 forms a an upwardly extending dam wall 310 with an inwardly extending lip 312. Dam wall 310 and platen hub 258 form the sides of reservoir 302.

Stationary slurry feed assembly 304 includes a bracket 320 attached to the bottom of table top 83. Bracket 320 includes a tapped hole 322 threaded with a male end of a fitting of a slurry feed line 324. A bored and sealed horizontal passage 326 in bracket 320 connects tapped hole 322 to a vertical passage 328. Vertical passage 328 extends downwardly to the bottom of bracket 320 over reservoir 302 to supply slurry thereto. A fluid level sensor 340 extends downwardly from bracket 320 to detect the level of slurry 190 in reservoir 302 so that, when the level becomes too low, additional slurry is supplied through tapped hole 322.

Figure 9A:
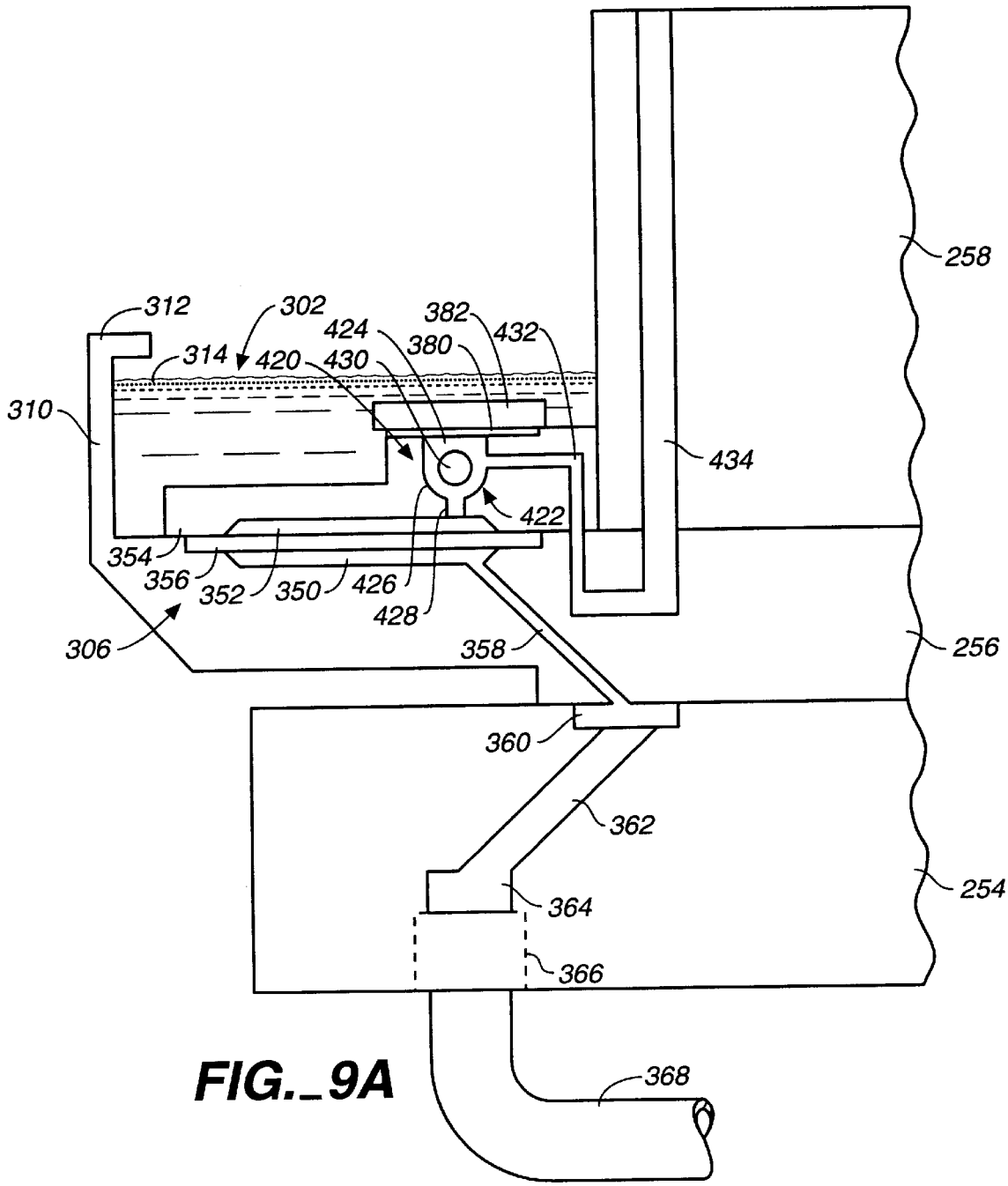
FIG. 9A is a schematic cross-sectional view of a pump system including a frontside flow check assembly for the reservoir of FIG. 8.
Figure 9B:
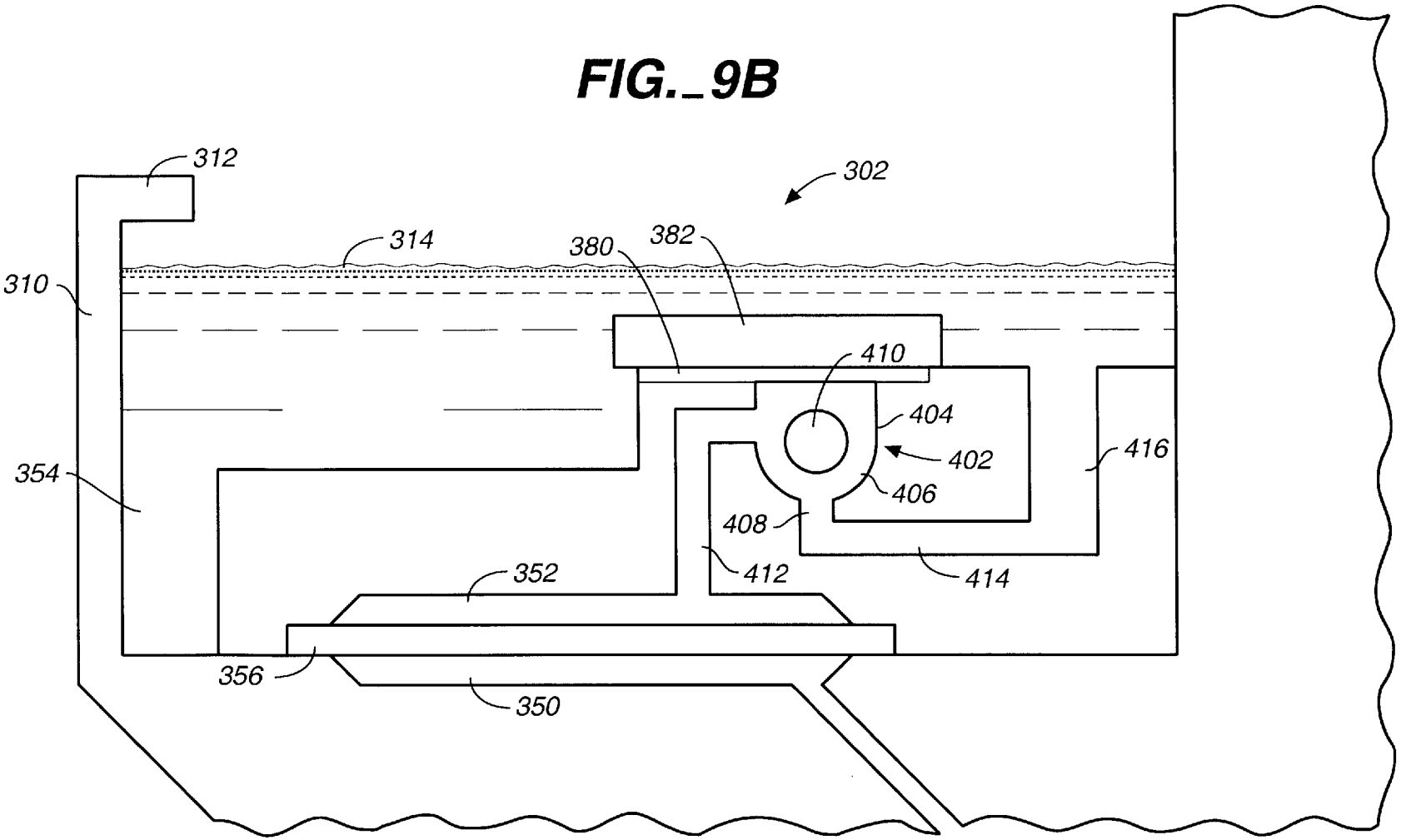
FIG. 9B is an enlarged schematic cross-sectional view of a backside flow check assembly for the reservoir of FIG. 8.

Rotating slurry pump 306, shown in FIGS. 9A and 9B, pumps slurry from reservoir 302 to center port 202. The slurry pump includes a lower recess 350 formed in reservoir hub 256 and an opposed upper recess 352 formed in an overlying pump member 354 which is screwed to reservoir hub 256. A flexible diaphragm 356 separates upper recess 352 from lower recess 350.

Pump 306 is pneumatically powered by a pneumatic fluid, such as air, selectively supplied under varying pressure by a stationary pneumatic source installed in or adjacent to machine base 82. The pneumatic source applies a positive pressure to cause diaphragm 356 to flex upwardly or a negative pressure to cause diaphragm 356 to flex downwardly. The flexing of the diaphragm provides a pumping motion for the slurry fluid in upper recess 352. The pneumatic fluid flows into and out of lower recess 350 through a passageway 358 to a sealed chamber 360 in hub sheave 254. A second passage 362 in hub sheave 254 connects sealed chamber 360 to a tapped hole 364 at the bottom of hub sheave 254. A coupling 366 connects tapped hole 364 to a flexible pneumatic line 368. As shown in FIG. 7, a coupling 370 connects pneumatic line 368 to an axial passage 372 in a rotating motor shaft 374. A rotary coupling 376 connects axial passage 372 to a stationary pneumatic source 378 such as a pneumatic line providing nitrogen.

Pump member 354 overlying diaphragm 356 seals the diaphragm to the reservoir hub to prevent fluid leakage between lower recess 350 and upper recess 352. Two flow check assemblies 400 (shown in FIG. 9B) and 420 (shown in FIG. 9A) are formed in pump member 354 to prevent the flow of fluid opposite the pumping direction. As discussed in detail below, each flow check assembly includes a cylindrical chamber having a large radius upper part, a tapered middle part, and a smaller radius lower part. The top of each cylindrical chamber is sealed with a generally rectangular seal member 380 biased by a pump cover 382 screwed into pump member 354.

As shown in FIG. 9B, a backside flow check assembly 400 is used to supply slurry to the upper recess 352 of pump 306. Backside flow check assembly 400 includes a first cylindrical chamber 402 having an upper part 404, a tapered middle part 406, and a lower part 408, which has a smaller radius than upper part 404. A first valve ball 410 is located in cylindrical chamber 402. First valve ball 410 has a diameter smaller than the diameter of upper part 404 but larger than lower part 408. When the fluid pressure in upper part 404 is greater than the pressure in lower part 408, valve ball 410 presses against the tapered middle part 406 to seal backside flow check assembly 400. Gravity assists the seal since valve ball 410 naturally seats itself on tapered middle part 406. A passageway 412 connects upper part 404 of first cylindrical chamber 402 to upper recess 352. A passageway 414 connects lower part 404 of first cylindrical chamber 402 to a sump 416 in reservoir 302. If diaphragm 356 flexes downwardly to provide negative pressure in upper recess 352, slurry will flow from lower part 408 and into upper recess 352. However, if diaphragm 356 flexes upwardly to provide positive pressure in upper recess 352, valve ball 410 will seal against tapered portion 406 to prevent backflow of slurry.

As shown in FIG. 9A, a frontside flow check assembly 420 is used to feed slurry from upper recess 352 to center port 202 in platen 110. Frontside flow check assembly 420 includes a second cylindrical chamber 422 having an upper part 424, a tapered middle part 426, and lower part 428 which has a smaller radius than upper part 424. A second valve ball 430 is located in cylindrical chamber 422. Second valve ball 430 has a diameter smaller than the diameter of upper part 424 but larger than lower part 428. Second valve ball 430 functions to seal frontside flow check assembly 420 in the same manner as first valve ball 410 seals backside flow check assembly 400. Lower part 428 of second cylindrical chamber 422 connects directly to upper recess 352. An L-shaped passage 432 in pump member 354 connects upper portion 424 of frontside flow check assembly 420 to a J-shaped passage 434 in reservoir hub 256 and platen hub 258. When positive pneumatic pressure flexes diaphragm 356 upwardly, the slurry in upper recess 352 is pumped through L-shaped passage 432, J-shaped passage 434, vertical passage 264, and angled passage 260 to center port 202 at the top of platen 110 (see FIG. 7). When negative pneumatic pressure flexes diaphragm 356 downwardly, the seating of second valve ball 430 in tapered middle part 426 prevents the back flow of slurry. In addition, the hook portion in J-shaped passage 434 creates a head which presses second valve ball 430 against tapered middle part 426.

Wiper Assembly

Figure 10A:
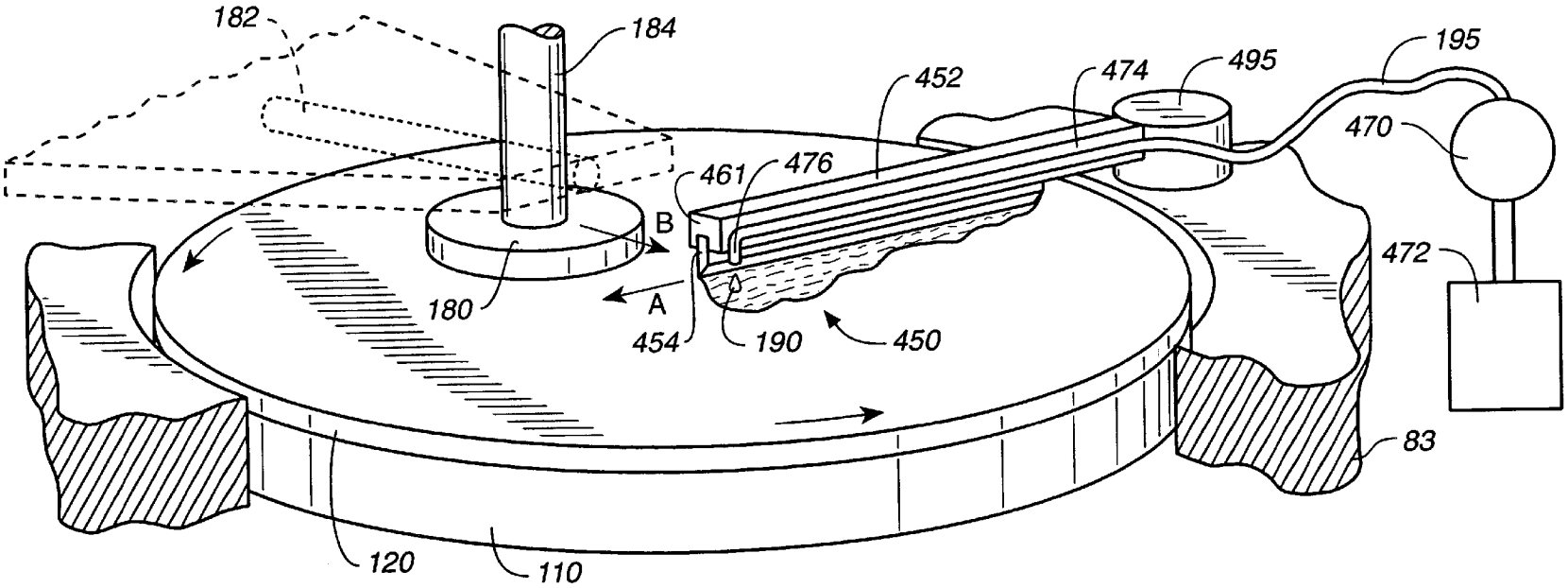
FIG. 10A is a schematic perspective view of a wiper apparatus for distributing slurry in accordance with the present invention.

As shown in FIG. 10A, the chemical mechanical polishing system of the present invention may include a wiper assembly 450. The wiper assembly is provided to distribute slurry evenly across the surface of polishing pad 120. As described in detail below, the wiper assembly includes a wiper blade to sweep the slurry across the polishing pad.

Wiper assembly 450 is positioned over the polishing pad near carrier head 180. As such, centrifugal forces created by the rotation of the polishing pad will not carry the slurry off the edge of the polishing pad before it reaches the carrier head. If polishing pad 120 is spinning counter-clockwise, then wiper assembly 450 may be positioned ninety degrees clockwise of carrier head 180.

Wiper assembly 450 includes a wiper arm 452 positioned above polishing pad 120, and extending inwardly from the edge and across and the polishing pad toward or over the center thereof. Wiper arm 452 may be a straight aluminum bar having a rectangular cross-section. Wiper arm 452 needs to be sufficiently rigid so it does not bend or flex. A thin layer of Teflon®, or some other material to which slurry will not adhere, covers the outer surface of wiper arm 452. One or more wiper blades 454 are attached and extend along underside 456 of wiper arm 452, as discussed in more detail in reference to FIGS. 11A and 11B.

Preferably, wiper arm 452 and radial slot 182 create a right angle to each other. The longitudinal axis of wiper arm 452 (indicated by arrow "A") and the linear sweep motion of substrate 10 across polishing pad 120 (indicated by arrow "B") are substantially perpendicular. In this configuration, the wiper arm 452 does not bump into carrier head 180 unless part of the carrier head moves over the center of the polishing pad 120. In another configuration, wiper arm 452 is about thirty to sixty degrees around polishing pad 120 from carrier head 180.

Wiper blade 454 is a flexible member formed of rubber, Teflon®, or some other flexible material that resists the adherence of slurry. The length of wiper blade 454 is about equal to the radius of polishing pad 120. For example, if polishing pad 120 has a diameter of twenty inches, wiper arm blade 454 may be about ten inches long.

Figure 10B:
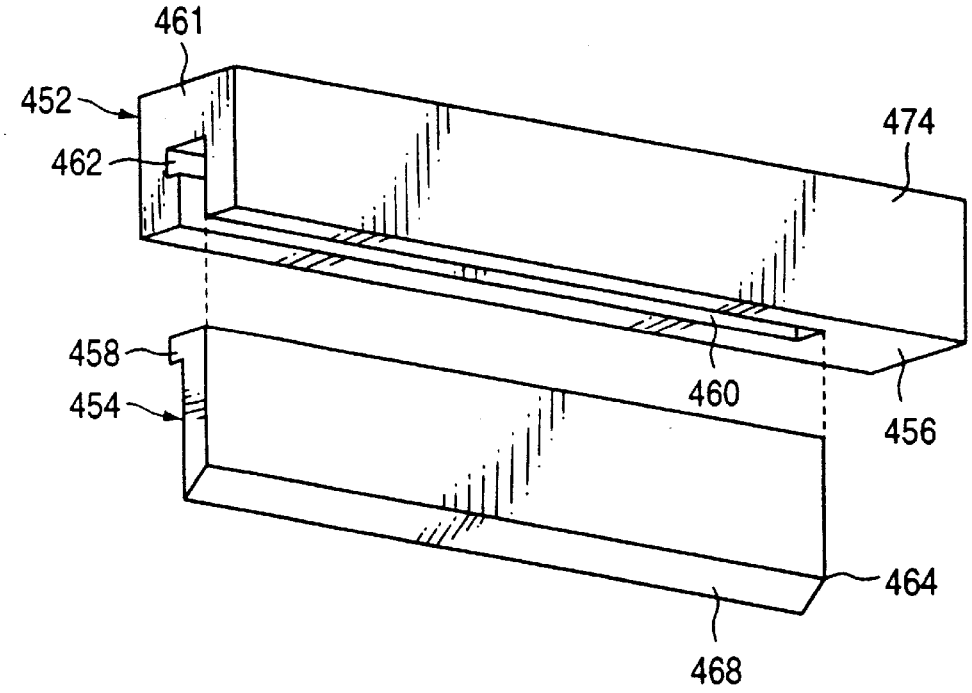
FIG. 10B is a schematic exploded perspective view of a wiper arm and wiper blade for the wiper apparatus of FIG. 10A.

Wiper blade 454 extends downwardly from wiper arm 452 to engage and sweep slurry across the surface of polishing pad 120. Although wiper blade 454 is mounted to wiper arm 452 so that it does not flex longitudinally, the wiper blade is thin enough to flex from side to side. As shown in FIG. 10B, the top edge of wiper blade 454 may have a protrusion 458 or section that is thicker than the remainder of the wiper blade. The underside 456 of wiper arm 452 may have a notch 460 extending along most of the length of the wiper arm. Notch 460 is open at an end 461 of the arm nearer to the center of the polishing pad. One side of notch 460 may have depression 462 along its upper edge. Wiper blade 454 is attached to wiper arm 452 by sliding the blade into the open end of the notch. The sides of wiper blade 454 engage the sides of notch 460, and the protrusion 458 fits in depression 462 to hold the wiper blade in place.

The bottom portion of wiper blade 454 has a bevelled edge 464. In one configuration, bevelled edge 464 presses against surface 122 of polishing pad 120. In another configuration, a gap 466 (see FIG. 11A) separates bevelled edge 464 from surface 122. The distance across gap 466 is less than the diameter of a droplet of slurry. Thus, the gap should be less than one-eighth of an inch, and more preferably about one-sixteenth of an inch. Beveled edge 464 has an angled leading surface 468 which faces opposite to the direction of rotation of the polishing pad.

As shown in FIG. 10A, a pump 470 is provided to pump slurry 190 from a slurry supply source 472 to a flexible slurry feed line 195. In the illustrated configuration, slurry feed line 195 runs along the outer surface 474 of wiper arm 452 and ends in a downwardly-turned feed port 476 at end 461 of the wiper arm. Slurry feed line 195 may be a plastic tube, about one-quarter of an inch in diameter. In another configuration, slurry feed line 195 is supported by brackets several inches above the wiper arm. In still another configuration, slurry feed line 195 could be an integral part of arm 452. For example, a passage could run through the arm to carry the slurry.

Figure 11A:
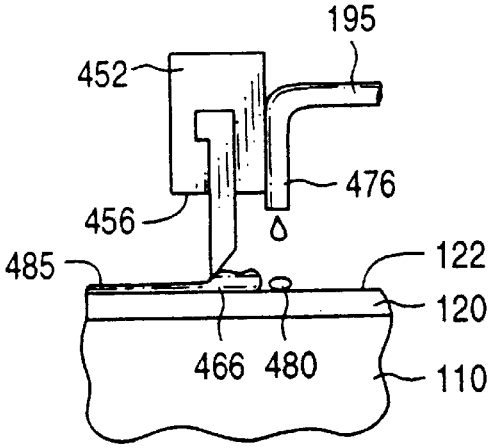
FIG. 11A is a schematic cross-sectional view of the wiper apparatus of FIG. 10A wherein one wiper blade is used to distribute slurry on a polishing pad.

Slurry feed line 195 distributes slurry to the surface of polishing pad 120 via feed port 476. Slurry may be distributed at a rate of about five to seventy-five milliliters per minute. As shown in FIG. 11A, because the slurry has a high surface tension, it collects on polishing pad 120 in droplets 480 about one-eighth of an inch in diameter. The rotation of polishing pad 120 carries the slurry droplets to leading surface 468 of wiper blade 454. The centrifugal force created by the rotation of polishing pad 120 spreads the slurry at leading surface 468 outwardly from the center of the pad to the edge of the pad. Some of the slurry passes beneath the wiper blade, and some of the slurry accumulates on the leading edge of the wiper blade. Thus, wiper blade 454 contacts the slurry droplets and spreads them evenly as a thin film 485 across the surface of the polishing pad. Bevelled edge 464 increases the downward pressure on droplets 480 as they pass under wiper blade 454 to aid in the even distribution of the slurry. If there is no gap between wiper blade 454 and surface 122, then the wiper blade will flex upwardly slightly to allow slurry to pass underneath.

Figure 11B:
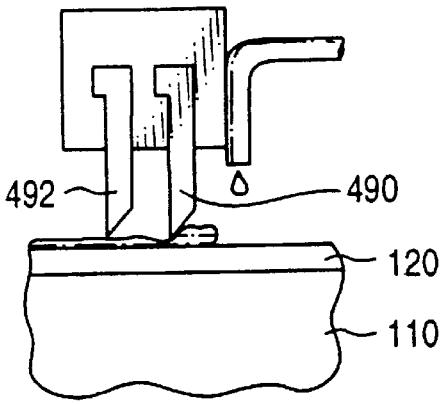
FIG. 11B is a schematic cross-sectional view of a wiper apparatus in accordance with the present invention using two wiper blades to distribute slurry on a polishing pad.

As shown in FIG. 11B, in an another embodiment, a leading wiper blades 490 and a trailing wiper blade 492 are attached to the underside 456' of wiper arm 452'. The use of two wiper blades substantially eliminates any non-uniformity in the distribution of slurry that passes under the first wiper blade. The gap separating trailing wiper blade 492 from polishing pad 120 is equal to or less than the gap separating leading wiper blade 490 from polishing pad 120.

The outer end of wiper arm 452 is connected to a rotating base 495, such as a pneumatic cylinder. Base 495 is itself mounted on table top 83. Rotating base 495 can pivot or swing wiper arm 452 along an arc that passes through the center of polishing pad 120. As discussed in more detail below, rotating base 495 moves the wiper arm so that if carrier head 180 moves over the center of the polishing pad, the carrier head does not contact wiper arm 452.

The slurry wiper assembly acts to evenly distribute the slurry across the surface of the polishing pad. It also limits the volume of slurry passing beneath the wiper blade. Thus, a slurry wiper assembly may be able to reduce the slurry required to polish a substrate by ninety percent, or more, compared to traditional slurry delivery mechanisms.

"Over-Center" Polishing

As discussed above, one of the primary objectives of CMP is planarity. The top or outermost surface must be extremely flat. However, even under normal polishing conditions, polishing may not produce a planar surface. First, the application of pressure by carrier head 180 to the substrate may be uneven. Second, the relative velocity between the substrate and polishing pad may be non-uniform across the surface of the substrate. The polishing rate at a given point on the substrate is proportional to the pressure applied at that point and the relative velocity between the substrate and polishing pad. Both the nonuniform pressure and velocity tend to create a radial "bulls-eye" pattern of depressed or elevated concentric rings. Often, the polishing rate is lower near the center of the substrate than at the edges of the substrate. If this is the case, then the polished substrate will be thicker at its center.

One technique to compensate for non-uniform polishing is "overhang" polishing the substrate is positioned partially off the edge of the polishing pad. However, overhang polishing creates a significant risk that the substrate will drop off the polishing pad and be damaged.

The polishing apparatus of the present invention avoids the above problems by placing substrate 10 over the center of the polishing pad. For a rotating disk, the velocity at a given point on the disk is proportional to the distance of that point from the center of the disk. As discussed above, the polishing rate is proportional to the relative velocity between the substrate and polishing pad. Therefore, the center of the polishing pad, with little or no surface velocity, can be used to control the removal rate across substrate 10. For example, if polishing station 200 is polishing substrate 10 too fast near the substrate edge, then the substrate edge can be positioned over the low velocity region near the center of the polishing pad for a higher portion of the total polishing time, thereby creating a reduced removal rate average for the substrate edge region.

Figure 12:
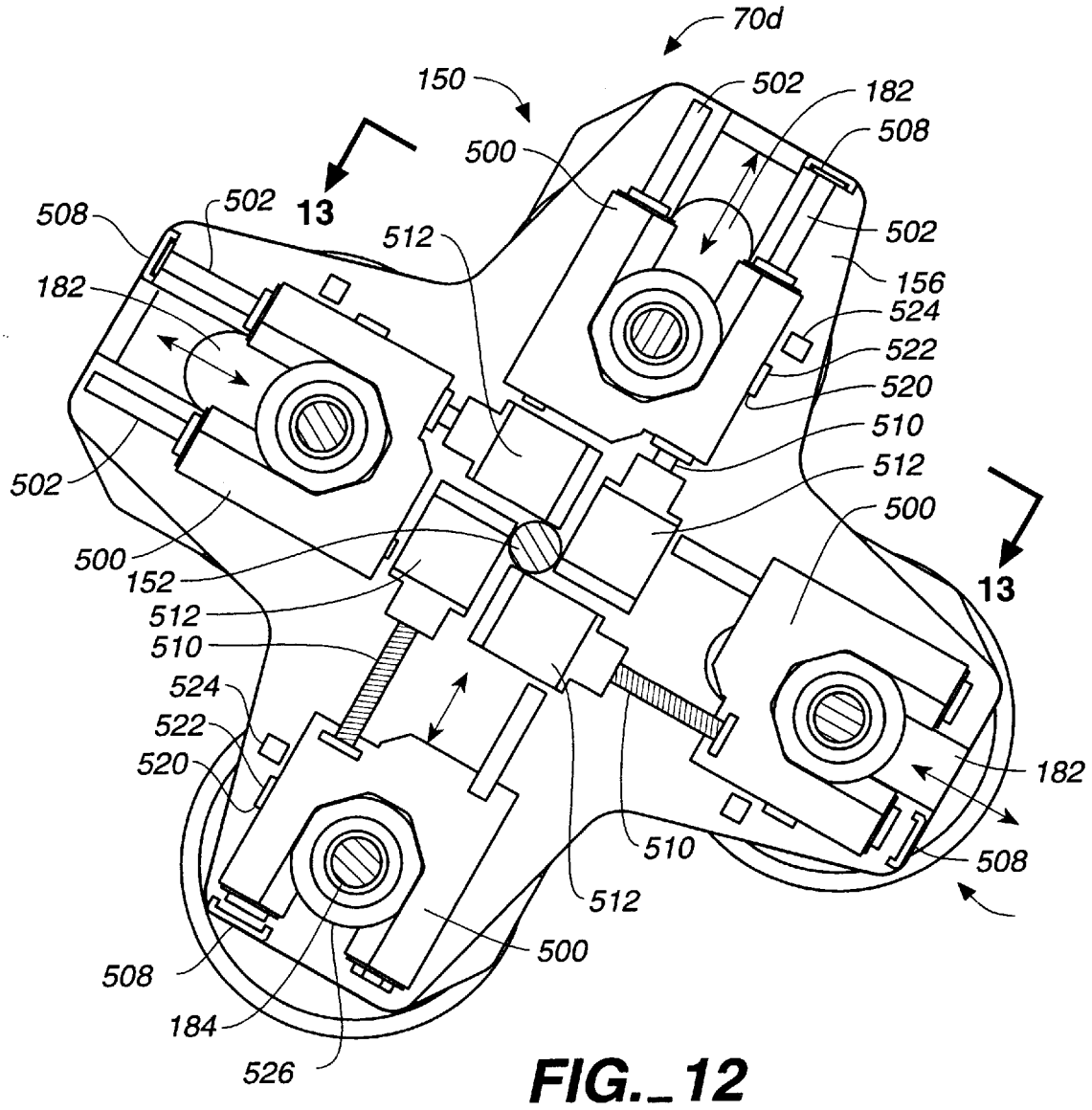
FIG. 12 is a schematic top view of a carousel with the upper housing removed.

Polishing apparatus 80 can cause drive shaft 184 to pass over the center of polishing pad 120. As shown in FIG. 12, in which cover 158 of carousel 150 has been removed, the thick (about six centimeters) support plate 156 supports the four carrier head systems 160*a*–160*d*. Carousel support plate includes four close-ended or open-ended slots 182, generally extending radially and oriented 90° apart. The top of support plate 156 supports four slotted carrier head support slides 500. Each slide 500 aligns along one of the slots 182 and moves freely along a radial path with respect to support plate 156. Two linear bearing assemblies bracket each slot 182 to support each slide 500.

Figure 13:
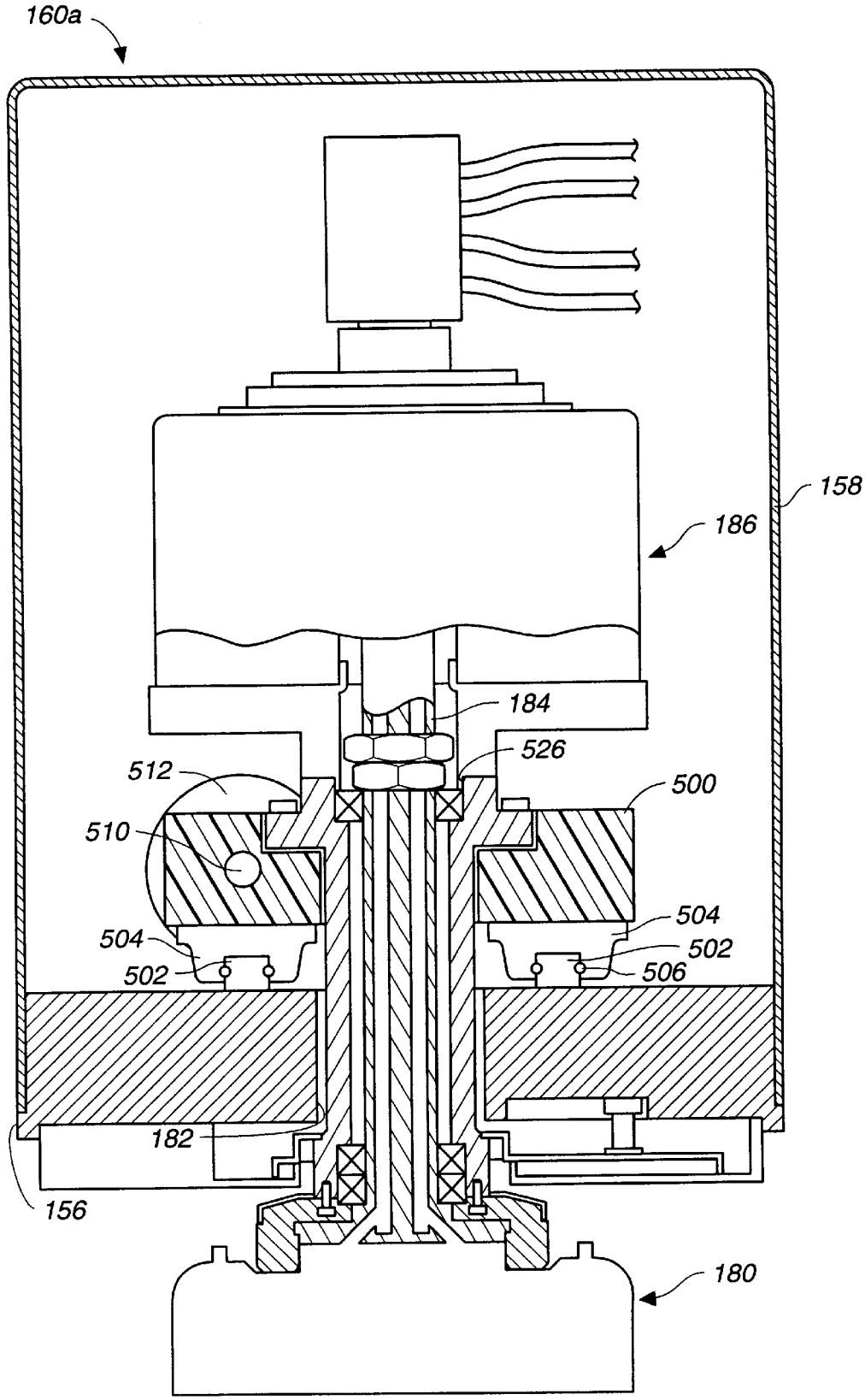
FIG. 13 is a schematic cross-section view of a carrier head assembly.

As shown in FIG. 13, each linear bearing assembly includes a rail 502 fixed to support plate 156, and two hands 504 (only one of which is illustrated) fixed to slide 500 which grasp the rail. A bearing 506 separates each hand 504 from rail 502 to provide free and smooth movement therebetween. Thus, the linear bearing assemblies permit the slides 500 to move freely along slots 182.

Referring again to FIG. 12, a bearing stop 508 anchored to the outer end of one of the rails 502 prevents slide 500 from accidentally coming off the end of the rail. One of the arms of each slide 500 contains an unillustrated recirculating ball threaded receiving cavity or nut fixed to the slide near its distal end. The threaded cavity or nut receives a worm-gear lead screw 510 driven by a motor 512 mounted on support plate 156. When motor 512 turns lead screw 510, slide 500 moves radially.

Each slide 500 is associated with an optical position sensor. An angle iron 520 having a horizontally extending wing 522 is attached to the worm side of each slide 500. An optical position sensor 524 is fixed to support plate 156. The height of sensor 524 is such that wing 522 passes through the two jaws of the sensor 524, and the linear position of sensor 524 passes from one side of sensor 524 to the other when slide 500 moves from its innermost position to its outermost position. Although the slide position is monitored by the input to motor 512 or an encoder attached thereto, such monitoring is indirect and accumulates error. The optical position sensor 524 calibrates the electronic monitoring and is particularly useful when there has been a power outage or similar loss of machine control.

A carrier head assembly, including a carrier head 180, a carrier drive shaft 184, a carrier motor 186, and a surrounding non-rotating shaft housing 526, is fixed to each of the four slides 500. When the carrier head assembly is positioned over a polishing station, slot 182 extends from the edge of platen 110 over its center. For example, if platen 110 is twenty inches in diameter, slot 182 is about five inches long and extends radially outward from about two inches to about seven inches from the center of the platen. Because drive shaft 184 extends through slot 182, carrier head 180, with its attached substrate 10, can be moved in a radial direction over the center of the polishing pad.

Figure 14:
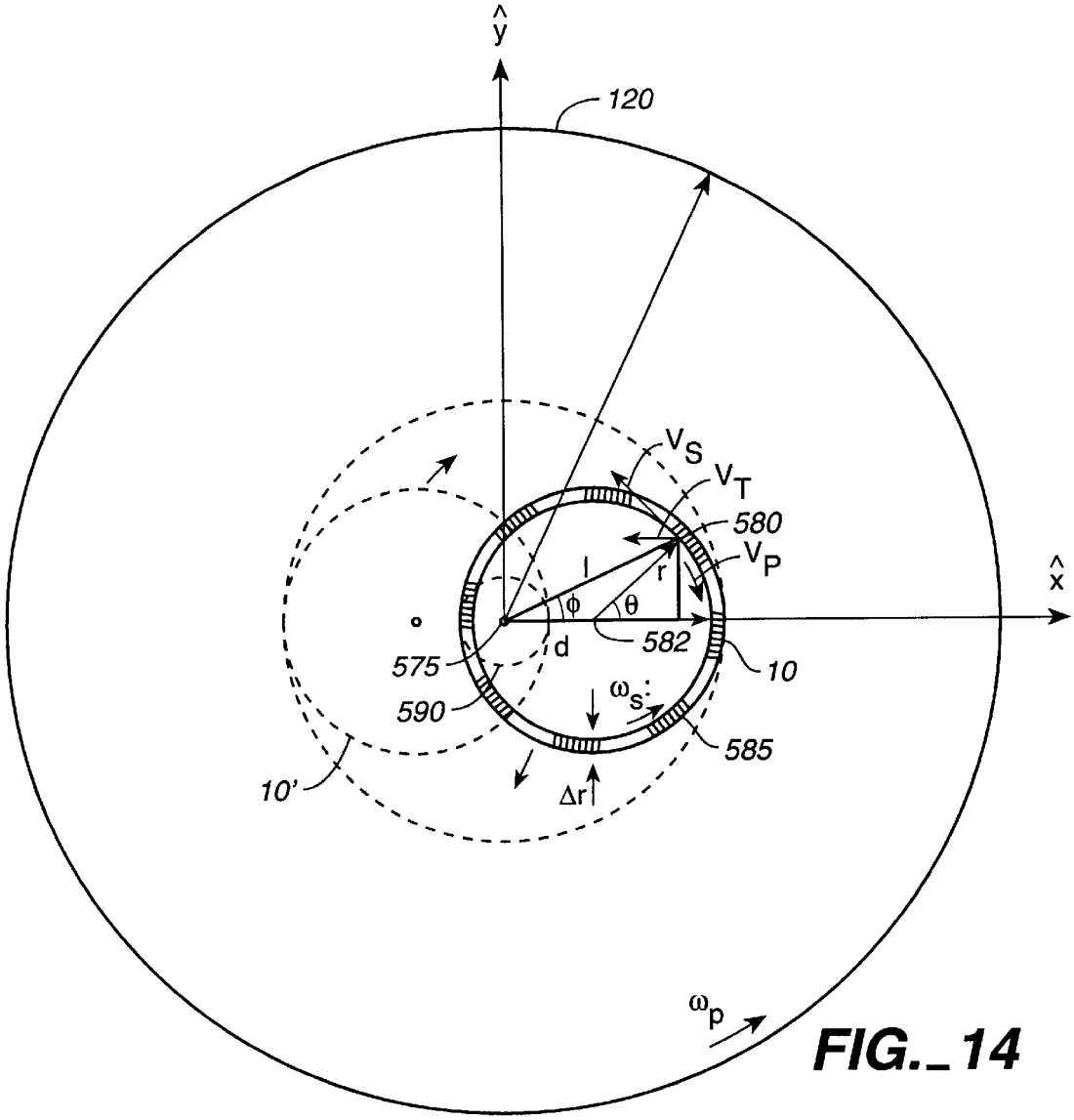
FIG. 14 is a schematic diagram illustrating the motion of a substrate over the center of a polishing pad in accordance with the present invention.

As illustrated by FIG. 14, substrate 10 is positioned over a center 575 of the polishing pad in order achieve the desired planarity. As discussed above, the rate of polishing is proportional to the relative velocity between the substrate and the polishing pad. The effect of over-center polishing for substrate uniformity may be modeled. The general technique of such modelling is described in the U.S. application Ser. No. 08/497,362, filed Jun. 30, 1995, entitled APPARATUS AND METHOD FOR SIMULATING AND OPTIMIZING A CHEMICAL MECHANICAL POLISHING SYSTEM, and assigned to the assignee of the present invention, the entire disclosure of which is hereby incorporated by reference.

If a stationary polishing pad is taken as a reference frame, then the total velocity $V_T$ at a point 580 on the substrate is the vector sum of the velocity of the pad $V_P$ and the velocity of the substrate $V_S$. As shown in FIG. 14, the velocity $V_P$ is normal to a linear segment "r" connecting point 580 to center 582 of substrate 10, whereas the velocity $V_S$ is normal to a linear segment "l" connecting point 580 on substrate 10 to center 575 of polishing pad 120.

The velocity due to rotation of the substrate is given by the equation:

$$V_S = r\omega_s \cos\theta y + r\omega_s \sin\theta x \tag{1}$$

where r is the distance between point 580 and center 575 of substrate 10, $\omega_s$ is the rotational rate of the substrate, θ is the angle between the x-axis and segment r, and x and y are unit vectors along the x-axis and y-axis, respectively.

The velocity due to rotation of the pad is given by the equation:

$$V_P = -l\omega_p \cos\phi y - l\omega_p \sin\phi x \tag{2}$$

where l is the distance between point 580 and center 582 of polishing pad 120, $\omega_p$ is the rotational rate of the pad, and φ is the angle between the x-axis and segment l. Note that if both the polishing pad and the substrate are rotating in the same direction, e.g., counter-clockwise, and at the same speed, then there is no relative motion between the pad and substrate, and $V_T$ should equal zero. From Equations 1 and 2, it may be calculated that:

$$V_T = (r\omega_s \cos\theta - l\omega_p \cos\phi)y + (r\omega_s \sin\theta - l\omega_p \sin\phi)x \tag{3}$$

Therefore, the speed S(r,θ) of point 580 on substrate 10 is:

$$\sqrt{(r\omega_s\cos\theta - 1\omega_p\cos\phi)^2 + (r\omega_s\sin\theta - 1\omega_p\sin\phi)^2} \tag{4}$$

Since point 580 travels entirely around ring 585, it will experience an average speed differential S(r) of:

$$\frac{1}{2\pi}\int_0^{2\pi} S(r,\theta)d\theta \tag{5}$$

Using standard trigonometry, it may be determined that:

$$\sin\phi = \frac{r}{l}\sin\theta \tag{6}$$

and

-continued $$\cos\phi = \sqrt{1 - \left[\frac{r}{l}\sin\theta\right]^2} \tag{7}$$

and $$l = \sqrt{r^2 + d^2 + rd\cos\theta} \tag{8}$$

where d is the distance between center 575 of polishing pad 120 and center 582 of the substrate 10.

Combining Equations (4)–(8) yields:

$$S(r) = \frac{1}{2\pi}\int_0^{2\pi}\sqrt{[r(\omega_s - \omega_p)\sin\theta]^2 + \left[r\omega_s\cos\theta - \omega_p\sqrt{r^2 + d^2 + rd\cos\theta - r\sin\theta(r^2 + d^2 + rd\cos\theta)^{\frac{1}{2}}}\right]^2}\, d\theta \tag{9}$$

Equation (9) may be solved analytically to determine the average velocity differential between the substrate and the pad as function of the radius of the substrate. It may be noted that as d approaches zero, Equation (9) simplifies to $S(r)=r(\omega_s-\omega_p)$ as expected.

As illustrated by FIG. 14, if substrate 10 is positioned over center 575; i.e., if the distance d between center 582 of substrate 10 and center 575 of polishing pad 120 is less than the radius of substrate 10, there will be a circular area 590 of polishing pad 120 which is always covered by substrate 10. The boundaries of circular area 590 may be determined by imagining that substrate 10 moves in an orbit of radius d around center 575 of the polishing pad. As shown by substrate 10 in position 10', the outer edge of substrate 10 closest to center 575 determines the boundary of circular area 590. The radius of circular area 590 is d-r. If slurry is provided solely by feed line 195 (see FIG. 10A) to the surface of polishing pad 120, circular area 590 will not be continually exposed to a new supply of slurry. Thus, portions of the polishing pad may become dry, resulting in non-uniform polishing. To avoid this problem, slurry can be provided through center port 202 when substrate 10 is positioned over center 575 of polishing pad 120.

Control System

Figure 15:
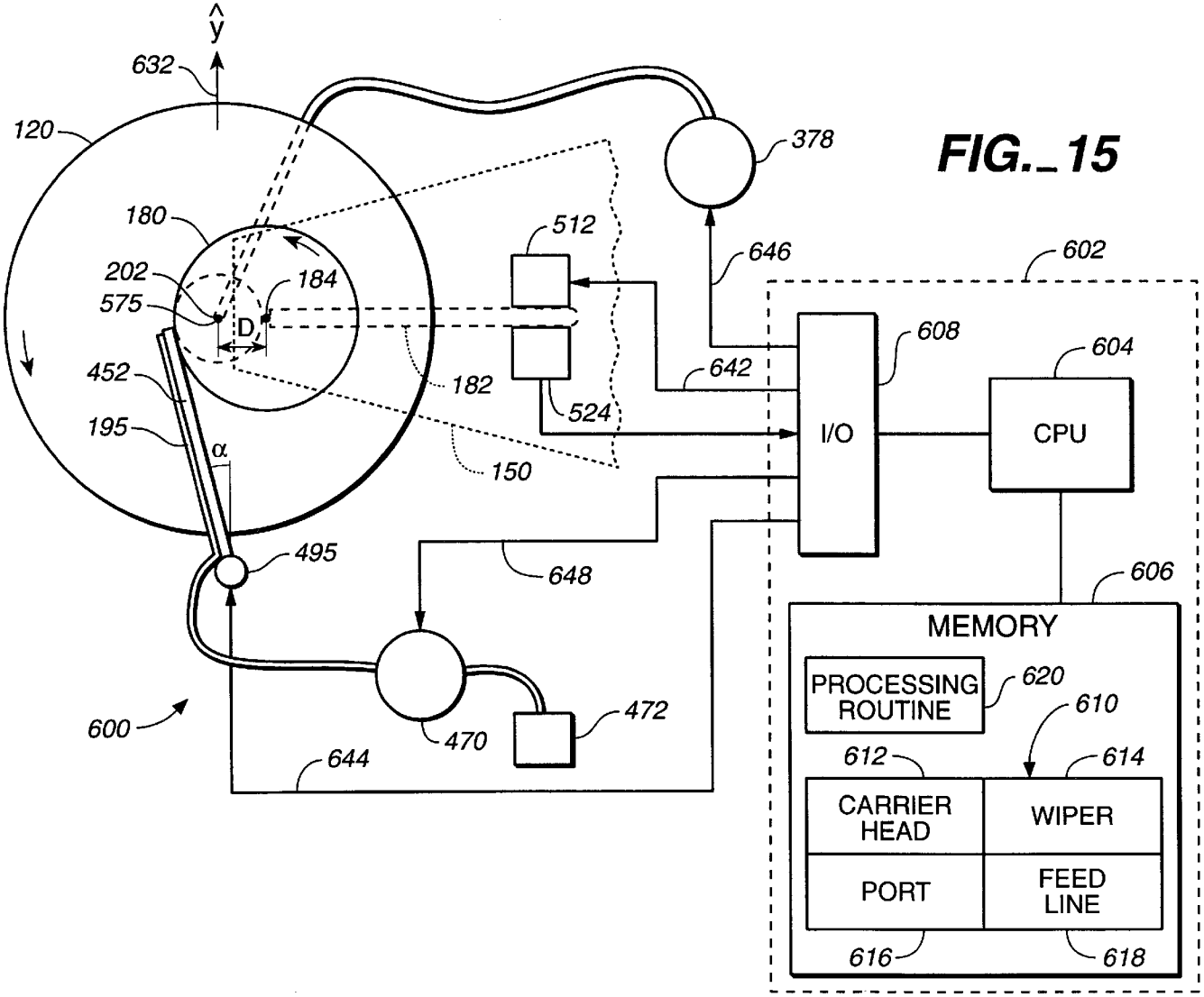
FIG. 15 is a block diagram of a control system to control the distribution of slurry to a polishing pad in accordance with the present invention.

Referring now to FIG. 15, a control system 600 is provided for controlling slurry pump 470, rotating base 495, and stationary pneumatic source 378. The control system optimizes the distribution of slurry to the surface of polishing pad 120 and prevents collisions between carrier head 180 and wiper assembly 450. Control system 600 is preferably a general purpose computer 602 having a central processing unit (CPU) 604, a memory 606, and an input/output (I/O) port 608. Computer 602 may also include a keyboard and a display (neither of which are shown) for direct operation by the manufacturer.

Control system 600 is connected through I/O port 608 to motor 512 to control the position of carrier head 180, to optical position sensor 524 to sense the position of slide 500, to pneumatic source 378 to control the flow of slurry through central port 202, to slurry pump 470 to control the flow of slurry through slurry feed line 195, and to rotating base 495 to control the position of wiper arm 452.

Before substrates are polished, a control program 610 and a processing routine 620 are stored in memory 606. Control program 610 in memory 606 includes four controls: a carrier head control 612, a wiper control 614, a port control 616, and a feed line control 618. Processing routine 620, as interpreted by control program 610, controls the polishing system.

Figure 16:
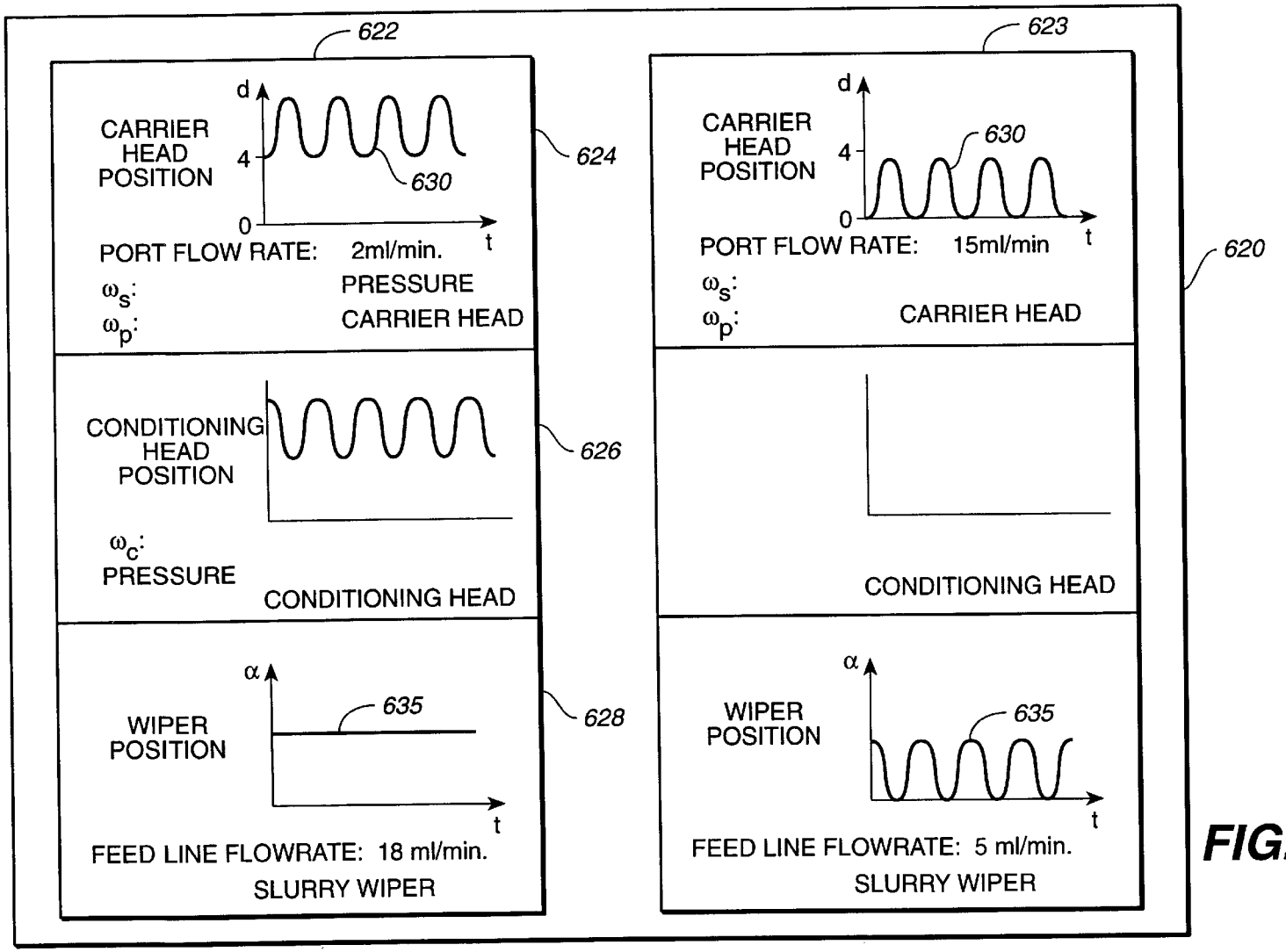
FIG. 16 is a diagram of a polishing procedure data file used by the control system of the present invention.

As illustrated by FIG. 16, processing routine 620 comprises a set of sequential processing steps 622 and 623. Each processing step comprises a set of three "recipes", including a carrier head recipe 624, a conditioning head recipe 626, and a slurry wiper recipe 628. Each "recipe" is a data file containing processing data which is used by control program 610 to control the polishing system. For example, carrier head recipe 624 contains a function 630 indicating the distance d from the center of the substrate to the center 575 of the polishing pad as a function of time, the flow rate of slurry through the central slurry feed port 202, the substrate rotation rate $\omega_s$, the polishing pad rotation rate $\omega_p$, and the polishing head pressure. Slurry wiper recipe 628 contains a function 635 indicating the angle $\alpha$ between the longitudinal axis of wiper arm 452 and a y-axis 632 (see FIG. 15) as a function of time, and the flow rate of slurry through the slurry feed line 195. Conditioning head recipe 626 contains a function controlling the position of conditioning head 134, the conditioning head rotation rate $\omega_c$, and the conditioning head pressure.

Returning to FIG. 15, control program 610 extracts data from processing routine 620 and converts that data into control signals which are sent to pneumatic source 378, pump 470, motor 512, and rotating base 495. Carrier head control 612 reads the carrier head function 630 and sends signals over line 642 to control motor 512. Wiper control 614 reads the wiper position function 635 and sends signals over line 644 to control rotating base 495. Slurry port control 616 reads the central port flow rate and sends signal over line 646 to control pneumatic source 378. Feed line control 618 reads the feed line flow rate and sends signals over line 648 to control pump 470.

Returning to FIG. 16, processing step 622 shows polishing processing conditions in which the substrate is not positioned over center 575 of polishing pad 120. Assuming that substrate 10 is eight inches in diameter, i.e., four inches in radius, carrier head function 630 sweeps the substrate across the polishing pad, but the distance d between the center of the substrate and the center of the polishing pad is always greater than four inches. Wiper function 635 keeps wiper arm 452 parallel with the y-axis (see FIG. 15). Because the carrier head will not pass over the center of the polishing pad, it will not collide with the wiper arm. The flow rate through center port 202 is set low, e.g., zero to three ml/minute, whereas the flow rate through slurry feed line 195 is high, e.g., about five to twenty ml/minute.

Processing step 623 shows polishing processing conditions in which the substrate is positioned over center 575 of the polishing pad. Again assuming that substrate 10 is eight inches in diameter, carrier head function 630 sweeps the substrate across the polishing pad, with the distance d between the center of the substrate and the center of the polishing pad less than four inches. Wiper function 635 must be set to prevent a collision of the slurry wiper assembly with carrier head 180. The wiper function can be set to sweep wiper arm 452 across the polishing pad in a oscillatory motion that is ninety degrees out of phase with the oscillation of the carrier head, so that the carrier head and slurry wiper arm maintain a constant distance. Alternately, the slurry wiper assembly can be moved off the polishing pad entirely. The flow rate through center port 202 is set high, e.g., ten to twenty ml/minute, whereas the flow rate through slurry feed line 195 is low, e.g., zero to five ml/minute. Since more slurry is provided through center port 202, less slurry is needed from feed line 195.

In one configuration of control system 600, the operators of a polishing apparatus select a carrier head function 630 and a wiper function 635 which ensures that wiper assembly 450 does not collide with carrier head 180. In another configuration of control system 600, there is a feedback mechanism which monitors the output position sensor 524 and adjusts rotating base 495 so that wiper assembly 450 does not bump into carrier head 180.

As discussed above, control system 600 controls the pressure of the slurry stream from center port 202 by adjusting the slurry flow rate with pneumatic source 378. If substrate 10 is positioned over center 575 and the pressure of the slurry stream is low, substrate 10 will block center port 202 and no slurry will escape. On the other hand, if the pressure is too high, the slurry stream will actually lift substrate 10 off polishing pad 120, and the polishing pad will not planarize the floating substrate.

Control system 600 avoids these problems by pumping slurry from port 202 in pulses. Processing routine 620 can control both the pulsing frequency and duration. To ensure a fairly continuous supply of slurry, there should be at least two pulses per minute. In one configuration, the polishing apparatus pumps slurry for five seconds and waits twenty seconds before beginning a new pulse, i.e., a pulse duration of 5 seconds and frequency of about 2.6 pulses/minute. The pressure of the slurry stream should be higher than the downward pressure of the carrier head to ensure that some slurry escapes the port. For example, if carrier head 180 applies a downward pressure of about seven psi to substrate 10, then a slurry pressure greater than seven psi, more preferably of about nine to twenty psi, will open a cavity in the bottom of substrate 10 without lifting the entire substrate off the polishing pad. When the pulse ends, carrier head 180 will force substrate 10 back down and push the slurry outwardly to distribute it to a wide area underneath substrate 10.

If the substrate is not positioned over center 575, and slurry is pumped through port center 202 at a high rate, e.g., twenty ml/minute, a geyser-like stream of slurry can be generated. Such a slurry stream can contaminate other components of the CMP system. Therefore, processing routine 620 reduces, or even stops, the flow of slurry through center port 202 when substrate 10 is not positioned over port 202.

In summary, slurry may be provided to the surface of the polishing pad by pumping the slurry in pulses through a central port, or by flowing the slurry through a slurry feed tube. A slurry wiper, which may have one or more flexible members, can be used to distribute the slurry evenly and thinly across the polishing pad. A control system can coordinate the distribution of slurry to the polishing pad and the movement of the carrier head and the wiper assembly to prevent collision therebetween.

The present invention has been described in terms of a preferred embodiment. The invention, however, is not limited to the embodiment depicted and described. Rather, the scope of the invention is defined by the appended claims.

What is claimed is:

1. A method of polishing a substrate in a chemical mechanical polishing apparatus comprising:

rotating said substrate;

rotating a polishing pad;

bringing said substrate into contact with said polishing pad with a carrier head;

moving said substrate relative to said polishing pad; and dispensing a slurry solution through a port in said polishing pad at a first flow rate if said substrate is not positioned over said port and at a second, different flow rate if said substrate is positioned over said port.

2. The method of claim 1 wherein said second flow rate is larger than said first flow rate.

3. The method of claim 1 wherein said dispensing step comprises pumping slurry through said port in intermittent pulses.

4. The method of claim 3 wherein said dispensing step comprises pumping said slurry in said intermittent pulses at a flow rate which is sufficiently high to overcome a pressure from said carrier head.

5. A method of polishing a substrate in a chemical mechanical polishing apparatus comprising:

rotating said substrate;

rotating a polishing pad;

bringing said substrate into contact with said polishing pad with a carrier head; and dispensing a slurry solution through a port in said polishing pad in intermittent pulses.

6. The method of claim 5 wherein said dispensing step comprises dispensing said slurry solution at a first flow rate if said substrate is not positioned over said port, and dispensing said slurry solution at a second flow rate if said substrate is positioned over said port.

7. The method of claim 6 wherein said second flow rate is larger than said first flow rate.

8. The method of claim 5 wherein said dispensing step comprises pumping said slurry in said intermittent pulses at a flow rate which is sufficiently high to overcome a pressure from said carrier head.

* * * * *

UNITED STATES PATENT AND TRADEMARK OFFICE

CERTIFICATE OF CORRECTION

PATENT NO. : 6,051,499
DATED : April 18, 2000
INVENTOR(S) : Robert D. Tolles et al.

It is certified that error appears in the above-identified patent and that said Letters Patent is hereby corrected as shown below:

Inventor,
Delete "Semyon Spektor, San Francisco; Ivan Ocanada, Modesto; Norm Shendon, San Carlos, all of California".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*